US010479578B2

(12) United States Patent
Zacherle et al.

(10) Patent No.: US 10,479,578 B2
(45) Date of Patent: Nov. 19, 2019

(54) BASKET STYLE CARRIER AND BLANK THEREFOR

(71) Applicant: WestRock Packaging Systems, LLC, Norcross, GA (US)

(72) Inventors: Matthew E. Zacherle, Chesterfield, VA (US); Bradford J. Walling, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 317 days.

(21) Appl. No.: 15/510,158

(22) PCT Filed: Sep. 4, 2015

(86) PCT No.: PCT/US2015/048542

§ 371 (c)(1),
(2) Date: Mar. 9, 2017

(87) PCT Pub. No.: WO2016/040159

PCT Pub. Date: Mar. 17, 2016

(65) Prior Publication Data

US 2017/0297795 A1 Oct. 19, 2017

Related U.S. Application Data

(60) Provisional application No. 62/049,697, filed on Sep. 12, 2014, provisional application No. 62/077,986, filed on Nov. 11, 2014.

(51) Int. Cl.
*B65D 71/58* (2006.01)
*B65D 5/02* (2006.01)
(Continued)

(52) U.S. Cl.
CPC ..... *B65D 71/0022* (2013.01); *B65D 5/02* (2013.01); *B65D 5/4266* (2013.01); *B65D 5/4608* (2013.01); *B65D 5/48014* (2013.01)

(58) Field of Classification Search
CPC ..... B65D 5/50; B65D 21/242; B65D 71/36; B65D 5/5002
(Continued)

(56) References Cited

U.S. PATENT DOCUMENTS 2,395,711 A * 2/1946 Arnold ..... B65D 71/0022 206/198
2,433,676 A * 12/1947 Ringler ..... B65D 71/0025 206/171
(Continued)

FOREIGN PATENT DOCUMENTS

EP 2703315 A1 3/2014
FR 2577520 A1 8/1986

*Primary Examiner* — Rafael A Ortiz
*Assistant Examiner* — Tia Cox
(74) *Attorney, Agent, or Firm* — WestRock Intellectual Property Group

(57) ABSTRACT

A carrier for packaging one or more articles, includes outer walls (12, 16, 18, 22*a*, 22*b*, 24*a*, 24*b*) which define an interior of the carrier. An intermediate wall (30*a*, 30*b*) at least partially segregates the interior of the carrier in a first direction. A partition structure (50*a*, 52*a*) divides the interior of the carrier in a second transverse direction. The partition structure is struck, at least in part, from one (16) of the outer walls. The partition structure is configured and arranged to be automatically erected in the interior of the carrier in response to unfolding a flat collapsed folded blank when the carrier is erected.

13 Claims, 29 Drawing Sheets

(51) Int. Cl.
*B65D 5/42* (2006.01)
*B65D 5/468* (2006.01)
*B65D 5/48* (2006.01)

(58) Field of Classification Search
USPC ..... 206/162, 188, 193, 173, 170, 174, 187; 220/62.1, 62, 531, 557, 529
See application file for complete search history.

(56) References Cited

U.S. PATENT DOCUMENTS

| | | | | | |
|---|---|---|---|---|---|
| 3,268,113 | A * | 8/1966 | Schuster | B65D 71/0022 | 206/187 |
| 4,403,727 | A * | 9/1983 | Grieve | B65D 5/4802 | 229/120.15 |
| 5,518,110 | A * | 5/1996 | Harrelson | B65D 71/0022 | 206/139 |
| 5,649,620 | A * | 7/1997 | Harrelson | B65D 71/0022 | 206/171 |
| 5,682,985 | A * | 11/1997 | Plaxico | B65D 71/0022 | 206/193 |
| 5,709,298 | A * | 1/1998 | Harris | B65D 71/0022 | 206/162 |
| 5,979,645 | A * | 11/1999 | Holley, Jr. | B65D 71/0022 | 206/175 |
| 2011/0048975 | A1 * | 3/2011 | Brand | B65D 71/0022 | 206/141 |

* cited by examiner

BASKET STYLE CARRIER AND BLANK THEREFOR

CROSS-REFERENCE TO RELATED APPLICATIONS

This application is a National Phase application of PCT Application PCT/US2015/048542, filed Sep. 4, 2015, which claims the benefit of U.S. Provisional Patent Application No. 62/049,697, filed Sep. 12, 2014 and U.S. Provisional Patent Application No. 62/077,986 filed Nov. 11, 2014, which are incorporated herein by reference in its entirety.

TECHNICAL FIELD

The present invention relates to a carrier and to a blank for forming the carrier more specifically, but not exclusively, to a basket style carrier having a partition structure for dividing the carrier into cells.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carrier or carton with a carrying handle for transportation by a consumer. It is also desirable to divide the carrier into cells so as to separate primary product containers from its adjacent neighbours.

The present invention seeks to overcome or at least mitigate the problems of the prior art.

SUMMARY

According to a first aspect of the present invention there is provided a carrier for packaging one or more articles. The carrier comprises a plurality of outer walls which define an interior. An intermediate wall at least partially segregates the interior of the carrier in a first direction. The carrier comprises at least one partition structure which divides the interior in a second transverse direction. The at least one partition structure may be struck, at least in part, from at least one of the plurality of outer walls. The at least one partition structure may be configured and arranged to be automatically erected in the interior of the carrier in response to unfolding a flat collapsed folded blank when the carrier is erected.

In some embodiments, a first partition structure is struck in part from a first outer wall and in part from a second outer wall, the second outer wall disposed adjacent to the first outer wall and a second partition structure struck in part from the second outer wall and in part from a third adjacent outer wall, the third outer wall disposed adjacent to the second outer wall and opposite the first outer wall.

According to a second aspect of the present invention there is provided a carrier for packaging one or more articles. The carrier comprises a plurality of outer walls which define an interior. An intermediate wall at least partially segregates the interior of the carrier in a first direction. A first partition structure divides, at least in part, the interior in a second transverse direction. The first partition structure may be struck, at least in part, from at least a first one of the plurality of outer walls so as to define a first window in the at least a first one of the plurality of outer walls at a first end of the carrier. A second partition structure divides, at least in part, the interior in a second transverse direction. The second partition structure may be struck, at least in part, from at least a second one of the plurality of outer walls so as to define a second window in the at least a second one of the plurality of outer walls at the first end of the carrier. The first and second partition structures may be configured and arranged to be automatically erected in the interior of the carrier in response to unfolding a flat collapsed folded blank when the carrier is erected.

Optionally, the first partition structure comprises a first panel struck from a first one of the plurality of outer walls and a second panel hinged to the first panel.

Optionally, the second panel is struck from a second one of the plurality of outer walls, the second one of the plurality of outer walls being disposed adjacent to the first one of the plurality of outer walls.

Optionally, the second one of the plurality of outer walls is hinged to the first one of the plurality of outer walls.

The second panel may be folded so as to at least partially segregates the interior of the carrier in the first direction.

Optionally, the second partition structure comprises a third panel struck from a third one of the plurality of outer walls and a fourth panel hinged to the third panel.

Optionally, the second panel is struck from the second one of the plurality of outer walls, the second one of the plurality of outer walls being disposed adjacent to the third one of the plurality of outer walls.

The second one of the plurality of outer walls may be hinged to the third one of the plurality of outer walls.

Optionally, the fourth panel is folded to at least partially segregates the interior of the carrier in the first direction.

The second window may be disposed transversely opposite the first window.

Optionally, the first and second partition structure are folded out of the plane of the respective panel from which they are struck prior to erection of the carrier from the flat collapsed folded blank.

According to a third aspect of the present invention there is provided a carrier for packaging one or more articles. The carrier comprises a plurality of outer walls which define an interior. An intermediate wall at least partially segregates the interior of the carrier in a first direction. The carrier comprises at least one partition structure which divides the interior in a second transverse direction. The at least one partition structure may be struck from at least a first one of the plurality of outer walls. The at least one partition structure may comprise a first panel hinged to one of the plurality of outer walls and a second panel comprising a first end edge along which first end edge the second panel is hinged to the first panel. The second panel may be secured to the intermediate wall.

Optionally, the at least one partition structure is configured and arranged to be automatically erected in the interior of the carrier when the carrier is erected from a flat collapsed folded blank.

In some embodiments, the at least one partition structure is struck from a first one of the plurality of walls and a second one of the plurality of walls, the second one of the plurality of walls being disposed adjacent to the first one of the plurality of walls.

The at least one partition structure may be struck in part from the intermediate wall.

Optionally, the second panel comprises a second free end edge opposing the first end edge.

The at least one of the plurality of outer walls comprises an outer surface and an inner surface and the second panel may be folded such that the inner surface of the second panel faces the inner surface of the at least one of the plurality of outer walls to which the first panel is hingedly connected.

Optionally, the carrier comprises at least two partition structures disposed on a first side of the intermediate wall.

In some embodiments, the intermediate wall is formed at least in part from a divider panel hinged to an end panel of the carrier.

In some embodiments, the intermediate wall is formed at least in part from a riser panel hinged to an end panel of the carrier.

In some embodiments, the intermediate wall is formed at least in part from a third panel forming part of an adjacent partition structure.

Optionally, the third panel is hinged to a fourth panel forming part of the adjacent partition structure, the fourth panel being hinged to said one of the plurality of outer walls.

In some embodiments, a portion of the second panel is struck from the first panel and forms a "T" shaped partition structure.

The intermediate wall may be formed from a first intermediate panel and a second intermediate panel, and the second panel may be secured at one end to the first intermediate panel and may be secured to the second intermediate panel at a second end.

Optionally, the second panel bridges a gap between the first intermediate panel and the second intermediate panel.

In some embodiments, the intermediate panel comprises a securing panel struck therefrom and hingedly connected thereto, the securing panel being secured in at least partial overlapping relationship with the first panel.

Optionally, the intermediate panel comprises at least one second partition structure struck therefrom and hinged thereto.

The at least one second partition structure may be secured to one of the plurality of outer walls.

Optionally, the carrier comprises at least one handle panel forming a carrying handle, the handle panel being secured to the intermediate panel.

Optionally, a portion of the intermediate panel forms a handle reinforcing panel and is disposed in face contacting relationship with a handle panel.

The intermediate panel may comprise a cutaway forming part of a carrying handle.

In some embodiments, the partition structure is struck from said one of the plurality of outer walls so as to at least partially define a window therein.

The window may extend into an adjacent one of the plurality of walls of the carrier.

According to a fourth aspect of the present invention there is provided a carrier for packaging one or more articles. The carrier comprises a plurality of outer walls which define an interior. An intermediate wall at least partially segregates the interior of the carrier in a first direction. The carrier may comprise at least one partition structure which divides the interior in a second transverse direction. The at least one partition structure may comprise a first partition panel struck from at least a first one of the plurality of outer walls and hinged to one of the plurality of outer walls and a second partition panel struck from the intermediate wall and hinged thereto. The second partition panel may be secured to the first partition panel.

In some embodiments, the at least one partition structure is configured and arranged to be automatically erected in the interior of the carrier when the carrier is erected from a flat collapsed folded blank.

In some embodiments, the at least one partition structure comprises a third partition panel struck from a second one of the plurality of outer walls and hinged thereto, the third panel folded to at least partially segregate the interior of the carrier in the first direction.

Optionally, the carrier comprises a fourth panel struck from one of the plurality of outer walls, the fourth panel having first end edge along which first end edge the fourth panel is hinged to the first panel.

A portion of the fourth panel may be struck from the first panel and form a "T" shaped partition structure.

In some embodiments, the intermediate wall is formed from a first intermediate panel and a second intermediate panel, and the fourth panel is secured at one end to the first intermediate panel and is secured to the second intermediate panel at a second end.

The fourth panel may bridge a gap between the first intermediate panel and the second intermediate panel.

According to a fifth aspect of the present invention there is provided a carrier for packaging one or more articles. The carrier comprises a plurality of outer walls which define an interior, the plurality of outer walls including a first side wall and a second side wall. An intermediate wall at least partially segregates the interior of the carrier in a first direction. The intermediate wall may be formed from at least one intermediate panel. The carrier may comprise a carrying handle having at least one handle panel. At least one first partition structure may divide the interior in a second transverse direction. The at least one first partition structure may be struck from and hinged to the at least one intermediate panel. At least one second partition structure may divide the interior in a second transverse direction. The at least one second partition structure may comprise a first partition panel hinged at a first end to one of the first or second side walls and hinged at a second, opposing, end to the at least one handle panel.

In some embodiments, the carrying handle comprises a first handle panel and a second handle panel hinged thereto for reinforcing the carrying handle and wherein the first partition panel is hinged at the second, opposing, end to the second handle panel.

According to a sixth aspect of the present invention there is provided a blank for forming a carrier. The blank may comprise; a plurality of outer wall panels for forming outer walls which define an interior in an erected carrier, at least one intermediate panel for forming an intermediate wall for at least partially segregating the interior of the carrier in a first direction, and at least one partition structure for dividing the interior in a second transverse direction, the at least one partition structure struck, at least in part, from at least one of the plurality of outer walls panels. The at least one partition structure may be configured and arranged to be automatically erected in the interior of the carrier in response to unfolding a flat collapsed folded blank when the carrier is erected.

According to a seventh aspect of the present invention there is provided a blank for forming a carrier. The blank may comprise; a plurality of outer wall panels for forming outer walls which define an interior in an erected carrier, at least one intermediate panel for forming an intermediate wall for at least partially segregating the interior of the carrier in a first direction, and at least one partition structure for dividing the interior in a second transverse direction. The at least one partition structure may be struck from at least a first one of the plurality of outer wall panels. The at least one partition structure may comprise; a first panel hinged to one of the plurality of outer wall panels and a second panel comprising a first end edge along which first end edge the second panel is hinged to the first panel. The second panel may be arranged to be securable to one of at least one intermediate panels.

According to an eighth aspect of the present invention there is provided a blank for forming a carrier. The blank may comprise; a plurality of outer wall panels for forming outer walls which define an interior in an erected carrier, at least one intermediate panel for forming an intermediate wall for at least partially segregating the interior of the carrier in a first direction, and at least one partition structure for dividing the interior in a second transverse direction. The partition structure may comprise; a first partition panel struck from at least a first one of the plurality of outer wall panels and hinged to one of the plurality of outer walls and a second partition panel struck from the at least one intermediate panel and hinged thereto. The second partition panel may be arranged to be securable to the first partition panel.

According to a ninth aspect of the present invention there is provided a blank for forming a carrier. The blank may comprise a plurality of outer wall panels for forming outer walls which define an interior in an erected carrier, the plurality of outer wall panels including a first side panel and a second side panel. The blank may comprise; at least one intermediate panel for forming an intermediate wall which at least partially segregates the interior of the carrier in a first direction, at least one handle panel for forming a carrying handle, at least one first partition structure for dividing the interior in a second transverse direction. The at least one first partition structure may be struck from at least one intermediate panel and may be hinged to the at least one intermediate panel. At least one second partition structure may divide the interior in a second transverse direction. The at least one second partition structure may comprise a first partition panel hinged at a first end to one of the first or second side walls and hinged at a second, opposing, end to the at least one handle panel.

According to a tenth aspect of the present invention there is provided a blank for forming a carrier. The blank comprises a plurality of outer wall panels for forming outer walls which define an interior in an erected carrier. The blank may comprise at least one intermediate panel for forming an intermediate wall which at least partially segregates the interior of the carrier in a first direction. The blank may comprise a first partition structure for dividing, at least in part, the interior in a second transverse direction, wherein the first partition structure is struck, at least in part, from at least a first one of the plurality of outer walls so as to define a first window in the at least a first one of the plurality of outer walls at a first end of the carrier and a second partition structure for dividing, at least in part, the interior in a second transverse direction, wherein the second partition structure is struck, at least in part, from at least a second one of the plurality of outer walls so as to define a second window in the at least a second one of the plurality of outer walls at the first end of the carrier. The first and second partition structures may be configured and arranged to be automatically erected in the interior of the carrier in response to unfolding a flat collapsed folded blank when the carrier is erected.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
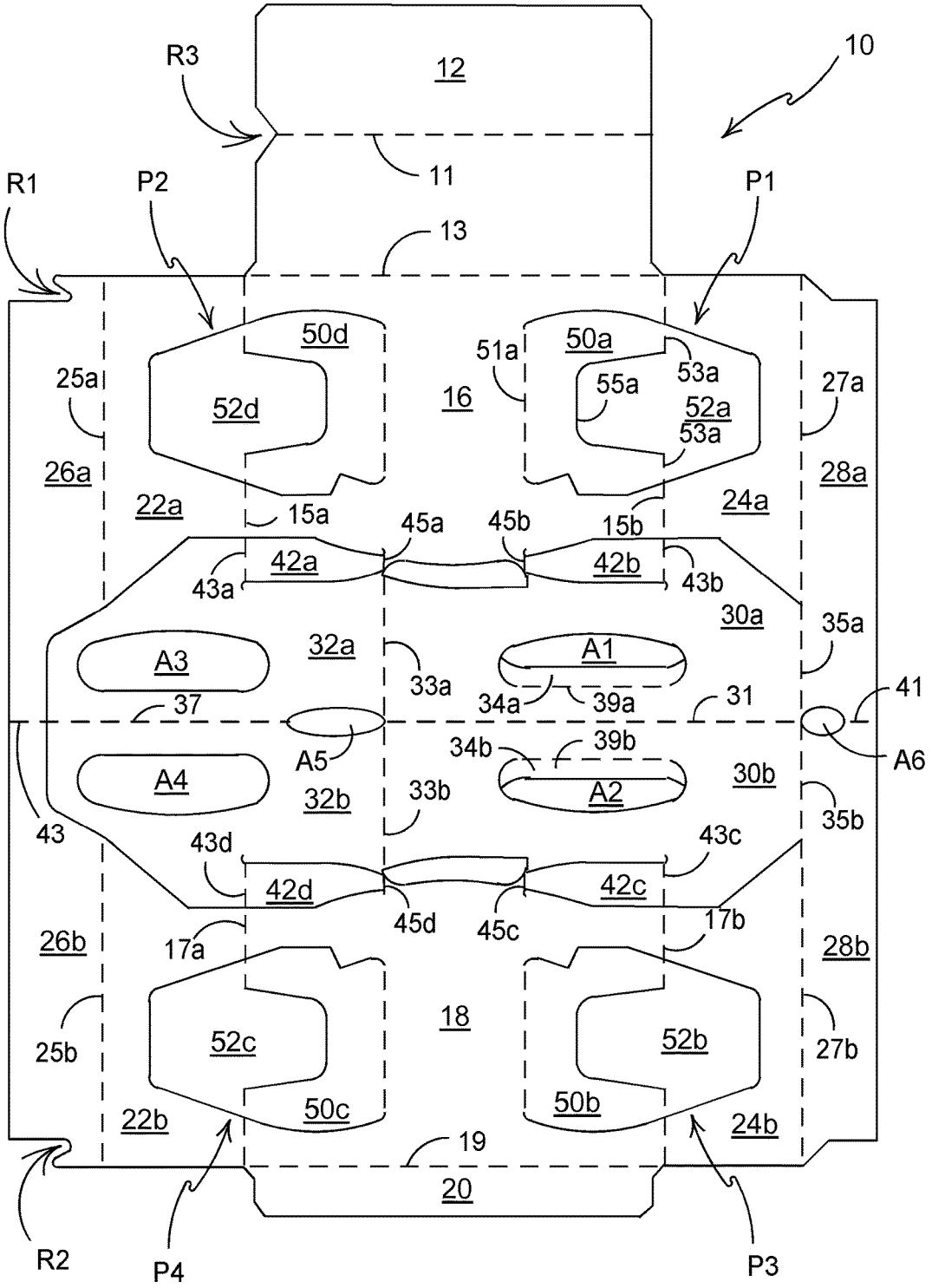
FIG. 1 is a plan view from above of a blank for forming a carrier according to a first embodiment.
Figure 3:
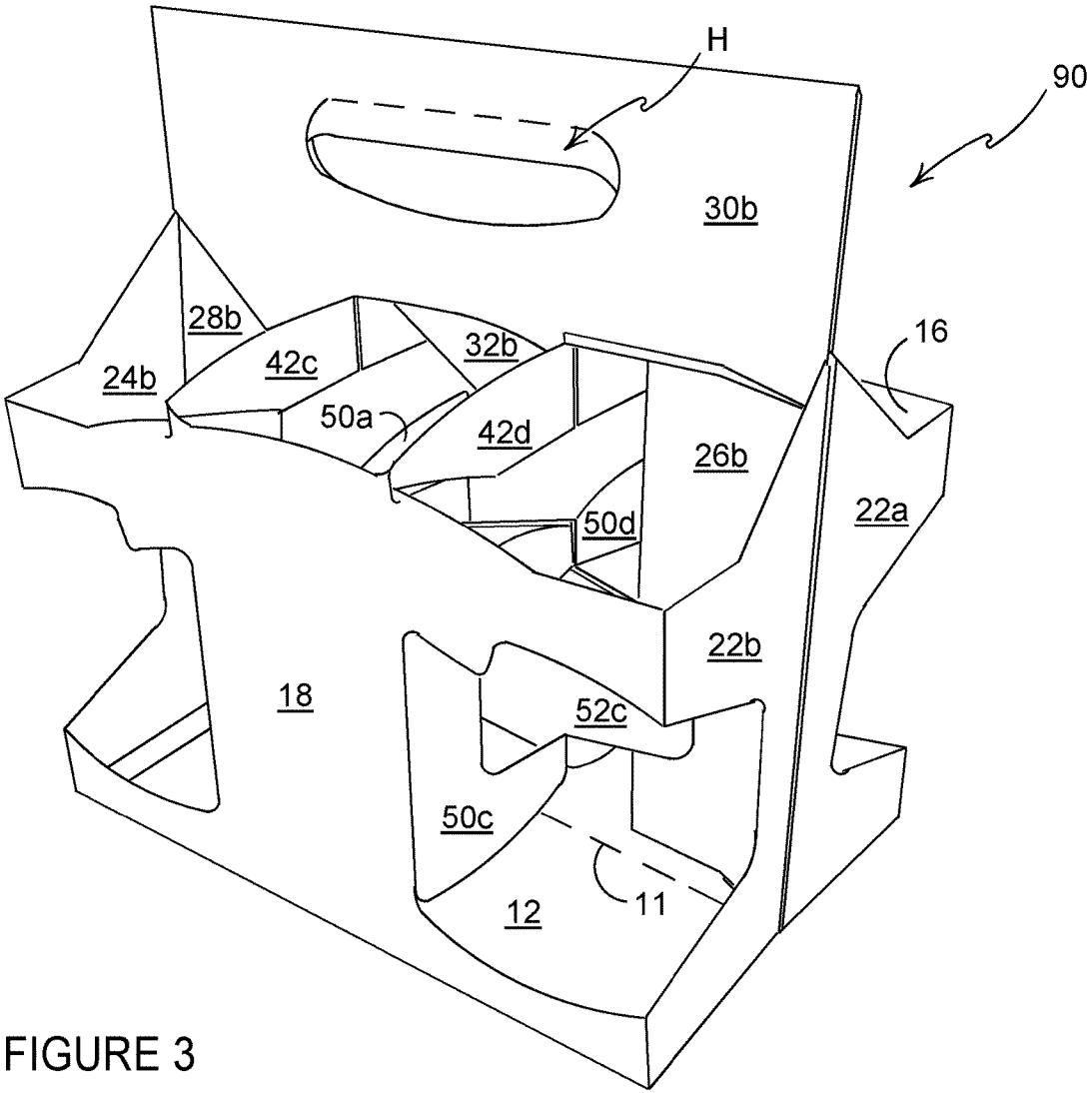
FIG. 3 is a perspective view from above of a carrier formed from the blank of FIG. 1.
Figure 4:
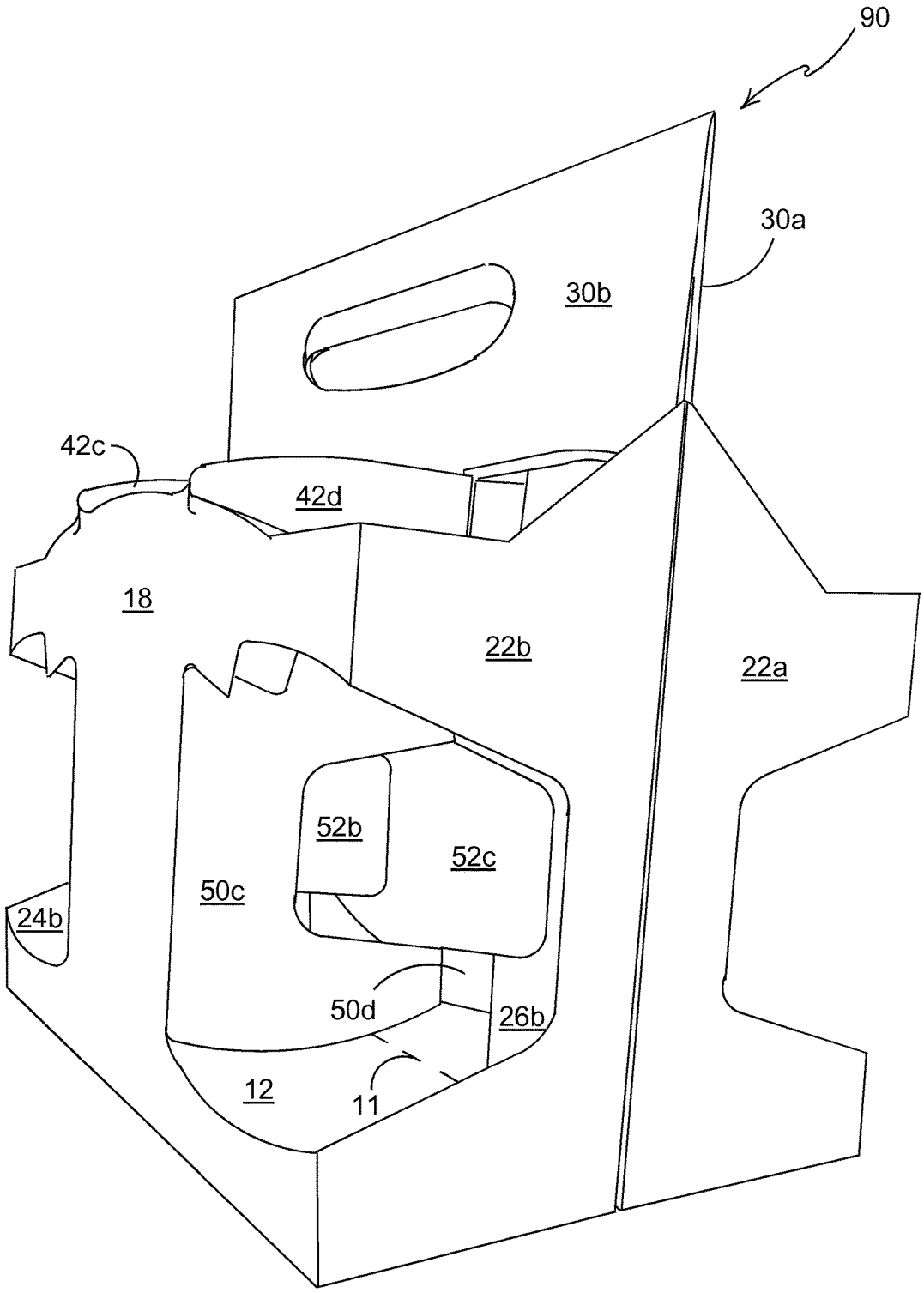
FIG. 4 is an alternative perspective view from above of the carrier of FIG. 3.
Figure 5:
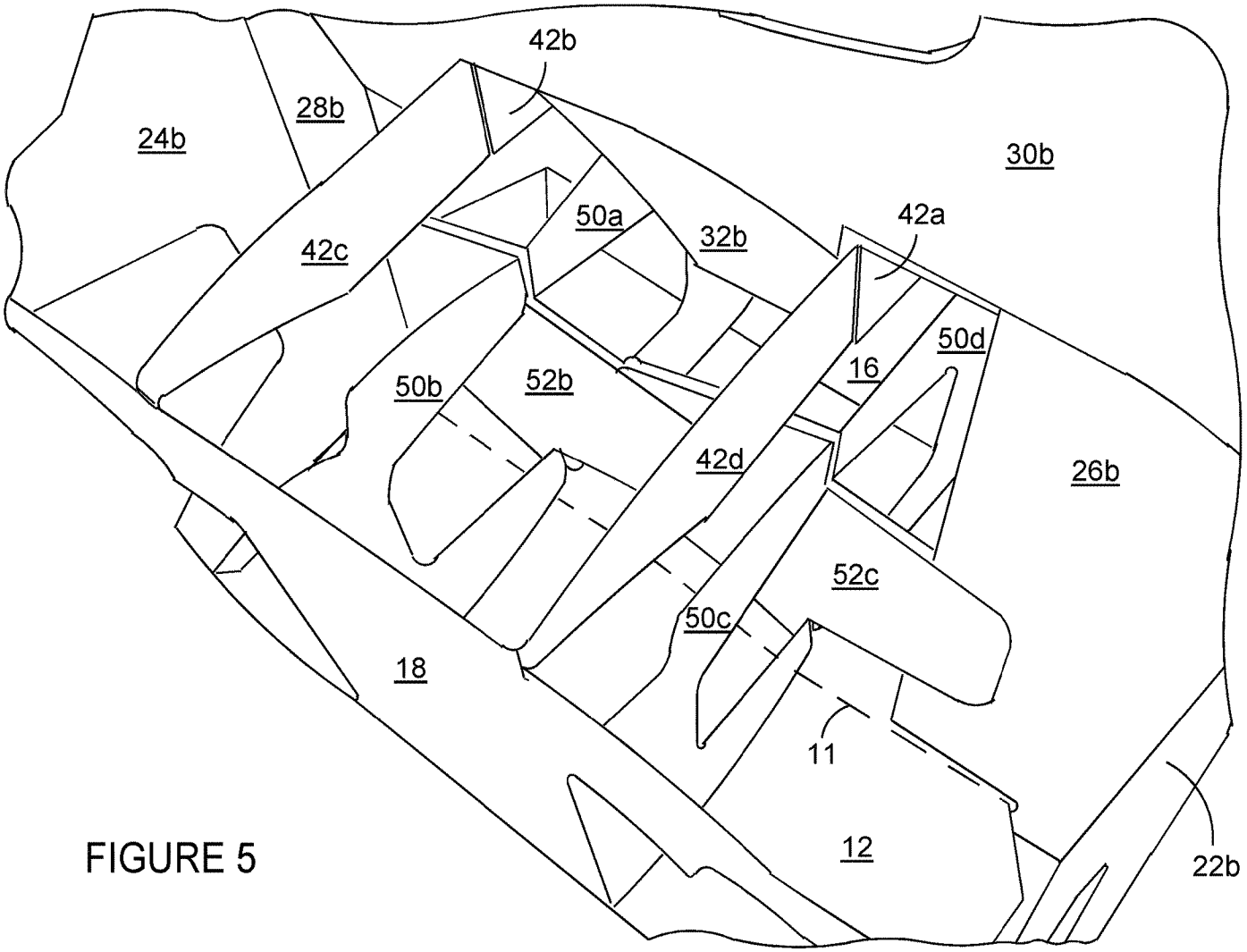
FIG. 5 is a perspective view from above of a portion of the carrier formed from the blank of FIG. 1 showing an internal cellular structure.
Figure 6:
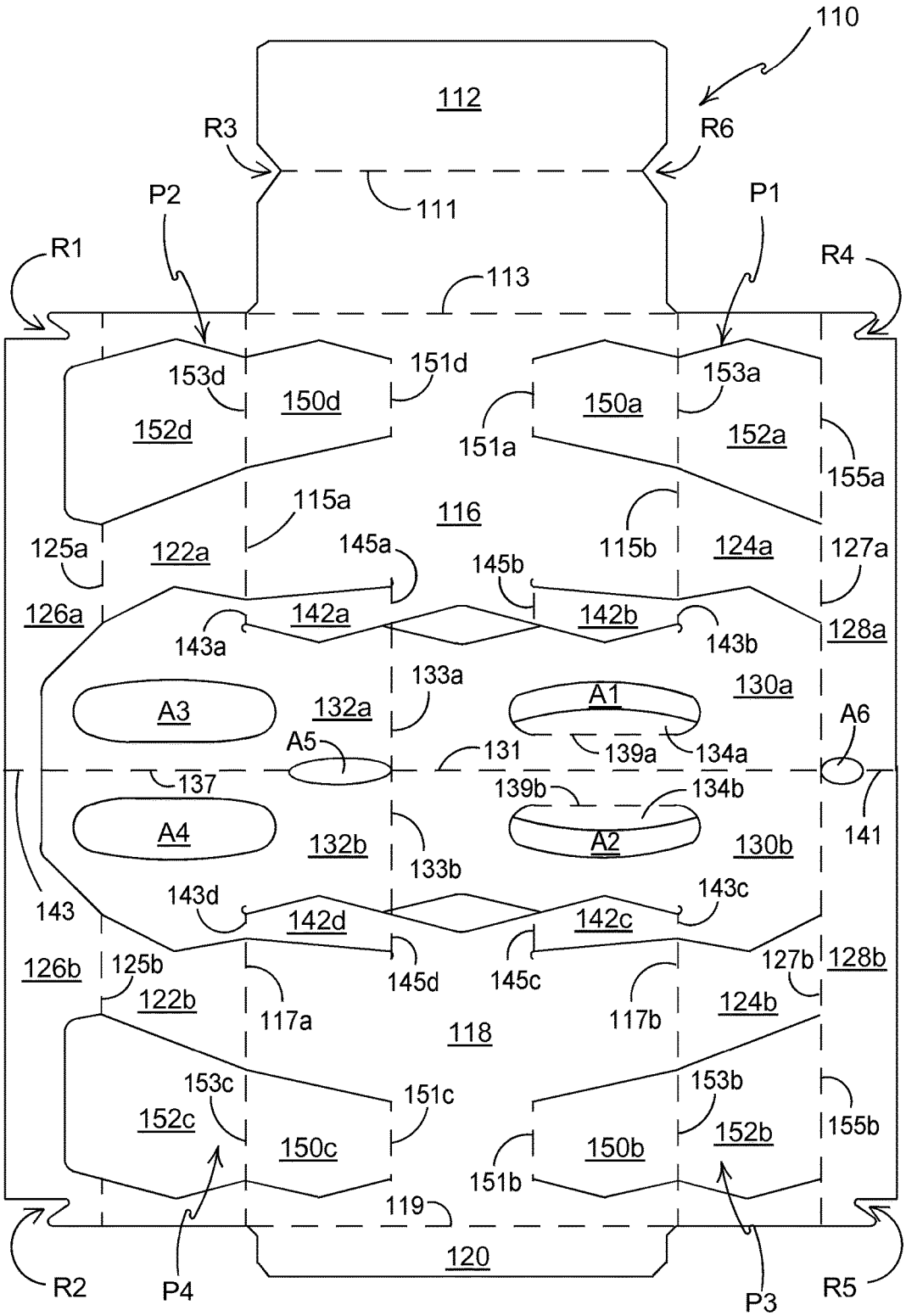
FIG. 6 is a plan view from above of a blank for forming a carrier according to a second embodiment.

Referring to FIG. 1, there is shown a plan view of a blank 10 capable of forming a carton or carrier 90 having a carrying handle H, as shown in FIG. 3, for primary products (not shown) such as, but not limited to, cans or bottles, hereinafter referred to as articles.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10, 110, 210, 310 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiments, the blanks 10, 110, 210, 310 are configured to form a carton or carrier for packaging an exemplary arrangement of exemplary articles. In the illustrated embodiments, the arrangement is a 2×3 matrix or array and the articles (not shown) are bottles. Alternatively, the blanks 10, 110, 210 can be configured to form a carrier for packaging other types, number and size of articles and/or for packaging articles in a different arrangement or configuration.

The blank 10 comprises a plurality of main panels 12, 16, 18, 20, 22*a*, 22*b*, 24*a*, 24*b* for forming walls of the carrier. The blank 10 comprises a base panel 12 hinged to a first side panel 16 by a fold line 13. The first side panel 16 is hinged at a first end to a first end panel 22*a* by a fold line 15*a*. The first side panel 16 is hinged at a second end to a second end panel 24*a* by a fold line 15*b*. The blank 10 comprises a second side panel 18. The second side panel 18 is hinged at a first end to a third end panel 22*b* by a fold line 17*a*. The second side panel 18 is hinged at a second end to a fourth end panel 24*b* by a fold line 17*b*. A securing panel 20 is hinged to the second side panel 18 by a fold line 19.

The first end panel 22*a* and the third end panel 22*b* together form a first end wall of the carrier 90. The second end panel 24*a* and the fourth end panel 24*b* together form a second end wall of the carrier 90.

The blank 10 comprises a first riser panel 26*a* hinged to the first end panel 22*a* by a fold line 25*a*. The blank 10 comprises a second riser panel 28*a* hinged to the second end panel 24*a* by a fold line 27*a*. The blank 10 comprises a third riser panel 26*b* hinged to the third end panel 22*b* by a fold line 25*b*. The blank 10 comprises a fourth riser panel 28*b* hinged to the fourth end panel 24*b* by a fold line 27*b*. The first riser panel 26*a* is hinged to the third riser panel 26*b* by a fold line 43. The second riser panel 28*a* is hinged to the fourth riser panel 28*b* by a fold line 41. Optionally, the fold line 41 is interrupted by an aperture A6 which is struck in part from the second riser panel 28*a* and in part from the fourth riser panel 28*b*.

The first riser panel 26*a* comprises a first recess R1 which is configured to form a hook like projection on a side edge thereof. The third riser panel 26*b* comprises a second recess R2 which is configured to form a hook like projection on a side edge thereof.

The base panel 12 comprises a fold line 11 which extends longitudinally thereacross so as to longitudinally bisect the base panel 12. The base panel 12 comprises a third recess R3 struck from a first end edge thereof; the fold line 11 extends from the third recess R3. The third recess R3 is configured to form a notch for interlocking with the hook like projections formed in the first riser panel 26*a* and the third riser panel 26*b*.

Together the first and third riser panels 26*a*, 26*b* couple the first end panel 22*a* to the third end panel 22*b*. Together the second and fourth riser panels 28*a*, 28*b* couple the second end panel 24*a* to the fourth end panel 24*b*.

The blank 10 comprises a first handle panel 30*a* and a second handle panel 30*b* disposed in part between the first side panel 16 and the second side panel 18. The first handle panel 30*a* and the second handle panel 30*b* are disposed in part between the second end panel 24*a* and the fourth end panel 24*b*.

The blank 10 comprises a first handle reinforcing panel 32*a* and a second handle reinforcing panel 32*b* disposed in part between the first side panel 16 and the second side panel 18. The first handle reinforcing panel 32*a* and the second handle reinforcing panel 32*b* are disposed in part between the first end panel 22*a* and the third end panel 22*b*. A portion of the first handle reinforcing panel 32*a* is struck from the first riser panel 26*a*. A portion of the second handle reinforcing panel 32*b* is struck from the third riser panel 26*b*.

The first handle panel 30*a* is hinged to the second handle panel 30*b* by a fold line 31. The first handle panel 30*a* is hinged to the second riser panel 28*a* by a fold line 35*a*. Fold line 35*a* is collinear with fold line 27*a* between the second end panel 24*a* and the second riser panel 28*a*.

The second handle panel 30*b* is hinged to the fourth riser panel 28*b* by a fold line 35*b*. Fold line 35*b* is collinear with fold line 27*b* between the fourth end panel 24*b* and the fourth riser panel 28*b*.

The first handle reinforcing panel 32*a* is hinged to the first handle panel 30*a* by a fold line 33*a*. The second handle reinforcing panel 32*b* is hinged to the second handle panel 30*b* by a fold line 33*b*.

The first handle reinforcing panel 32*a* is hinged to the second handle reinforcing panel 32*b* by a fold line 37. Optionally, the fold line 378 is interrupted by an aperture A5 which is struck in part from the first handle reinforcing panel 32*a* and in part from the second handle reinforcing panel 32*b*.

Fold line 43, fold line 37, fold line 31 and fold line 41 are arranged to be collinear with each other.

The first handle panel 30*a* comprises a first handle aperture A1 struck therefrom. The first handle aperture A1 is defined in part by an optional cushioning flap 34*a* which is hinged to the first handle panel 30*a* by a fold line 39*a*.

The second handle panel 30*b* comprises a second handle aperture A2 struck therefrom. The second handle aperture A2 is defined in part by an optional cushioning flap 34*b* which is hinged to the second handle panel 30*b* by a fold line 39*b*.

The first handle reinforcing panel 32*a* comprises a third handle aperture A3 struck therefrom. The second handle reinforcing panel 32*b* comprises a fourth handle aperture A4 struck therefrom.

In a constructed carrier 90, the first handle aperture A1, the second handle aperture A2, the third handle aperture A3 and the fourth handle aperture A4 together form a handle opening of the carrying handle H.

The blank 10 comprises a first connecting panel 42*a* hinged at a first end to the first side panel 16 by a fold line 45*a* and at a second end to the first handle reinforcing panel 32*a* by a fold line 43*a*. The first connecting panel 42*a* is disposed between first side panel 16 and the first handle reinforcing panel 32*a*.

The blank 10 comprises a second connecting panel 42*b* hinged at a first end to the first side panel 16 by a fold line 45*b* and at a second end to the first handle panel 30*a* by a fold line 43*b*. The second connecting panel 42*b* is disposed between first side panel 16 and the first handle panel 30*a*.

The blank 10 comprises a third connecting panel 42*c* hinged at a first end to the second side panel 18 by a fold line 45*c* and at a second end to the second handle panel 30*b* by a fold line 43*c*. The third connecting panel 42*c* is disposed between second side panel 18 and the second handle panel 30*b*.

The blank 10 comprises a fourth connecting panel 42*d* hinged at a first end to the second side panel 18 by a fold line 45*d* and at a second end to the second handle reinforcing panel 32*b* by a fold line 43*d*. The fourth connecting panel 42*d* is disposed between second side panel 18 and the second handle reinforcing panel 32*b*.

The blank 10 comprises a plurality of partition structures P1, P2, P3, P4. A first partition structure P1 is formed in part from the first side panel 16 and in part from the second end panel 24*a*.

A second partition structure P2 is formed in part from the first side panel 16 and in part from the first end panel 22*a*.

A third partition structure P3 is formed in part from the second side panel 18 and in part from the fourth end panel 24*b*.

A fourth partition structure P4 is formed in part from the second side panel 18 and in part from the third end panel 22*b*.

The first partition structure P1 comprises a first partition panel 50*a* struck from the first side panel 16 and a second partition panel 52*a* struck in part from the first side panel 16 and/or the first partition panel 50*a* and struck in part from the second end panel 24*a*. The second partition panel 52*a* is hinged to the first partition panel 50*a* by a fold line 53*a*. The fold line 53*a* is interrupted by a cutline or severance line 55*a*. Outline 55*a* is substantially "C" shaped or "U" shaped. The first partition panel 50*a* is hinged to the first side panel 16 by a fold line 51*a*.

The second partition structure P2 comprises a third partition panel 50*d* struck from the first side panel 16 and a fourth partition panel 52*d* struck in part from the first side panel 16 and/or the fourth partition panel 50*d* and struck in part from the first end panel 22*a*. The second partition structure P2 is substantially similar in structure to the first partition structure P1 and will not be described in further detail. The third partition structure P3 comprises a fifth partition panel 50*b* struck from the second side panel 18 and a sixth partition panel 52*b* struck in part from the second side panel 18 and/or the fifth partition panel 50*b* and struck in part from the fourth end panel 24*b*. The third partition structure P3 is substantially similar in structure to the first partition structure P1 and will not be described in further detail. The fourth partition structure P4 comprises a seventh partition panel 50*c* struck from the second side panel 18 and an eighth partition panel 52*c* struck in part from the second side panel 18 and/or the seventh partition panel 50*c* and struck in part from the third end panel 22*b*. The fourth partition structure P4 is substantially similar in structure to the first partition structure P1 and will not be described in further detail.

Turning to the construction of the carrier 90 as illustrated in FIGS. 2*a* to 2*f*, the carrier 90 can be formed by a series of sequential folding operations in a straight line machine so that the carrier 90 is not required to be rotated or inverted to complete its construction. The folding process is not limited to that described below and may be altered according to particular manufacturing requirements.

Figure 2C:
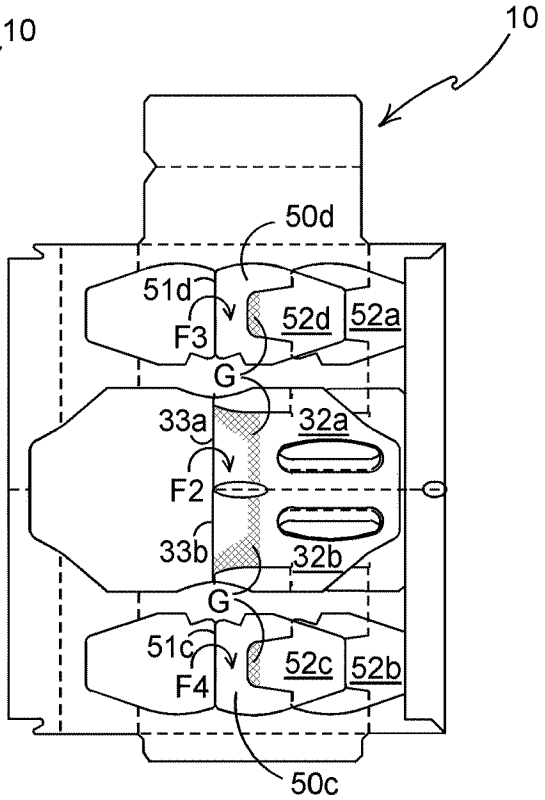
FIGS. 2*a* to 2*f* are plan views from above of stages of construction of the blank of FIG. 1.
Figure 2B:
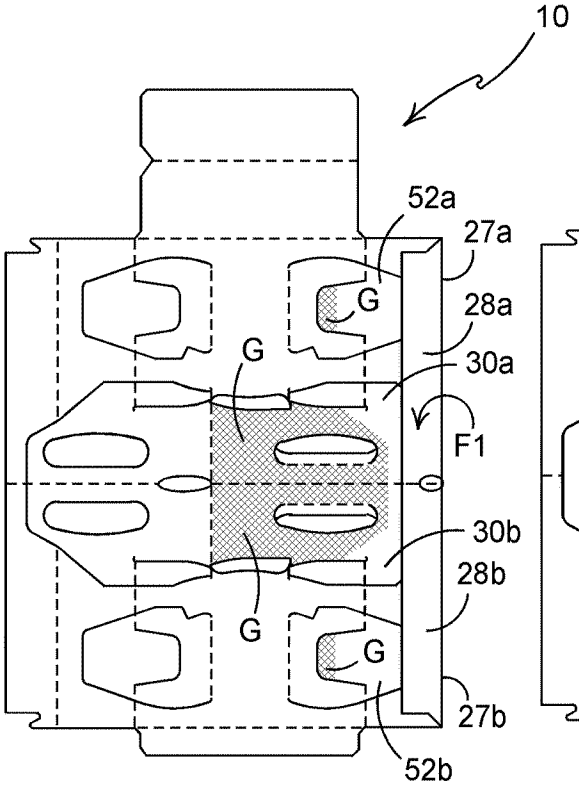
Figure 2A:
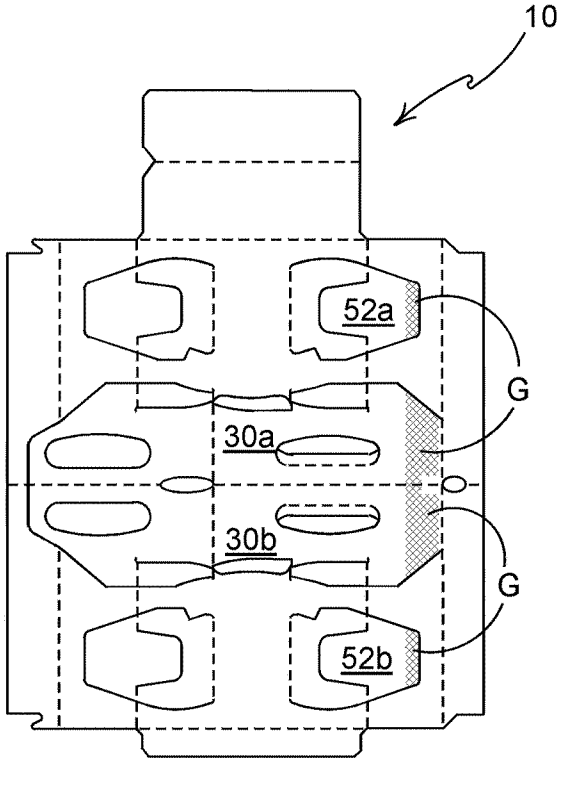

Glue G or other adhesive treatment is applied to a first end portion of the second partition panel 52*a*, to a first end portion of the sixth partition panel 52*b* and to end regions of the first and second handle panels 30*a*, 30*b*, as shown in FIG. 2*a*.

The blank 10 is folded, as shown in FIG. 2*b* by direction arrow F1, about fold lines 27*a* and 27*b* such that the second riser panel 28*a* and the fourth riser panel 28*b* are brought into face contacting relationship with each of the second end panel 24*a*, the fourth end panel 24*b*, the first and second handle panels 30*a*, 30*b* and the second and sixth partition panels 52*a*, 52*b*. The second riser panel 28*a* is secured to the first handle panel 30*a* and the second partition panel 52*a*. The fourth riser panel 28*b* is secured to the second handle panel 30*b* and the sixth partition panel 52*b*.

Glue G or other adhesive treatment is applied to a second end portion of the second partition panel 52*a*, to a second end portion of the sixth partition panel 52*b*. The second end portions of the second and sixth partition panels 52*a*, 52*b* are opposed to the respective first end portions of the second and sixth partition panels 52*a*, 52*b*. Glue or other adhesive treatment is applied to a region of each of the first and second handle panels 30*a*, 30*b*, as shown in FIG. 2*b*. The region of the first and second handle panels 30*a*, 30*b* to which glue or other adhesive treatment is applied corresponds to those portions of the first and second handle panels 30*a*, 30*b* which will be in face contacting relationship with the respective one of the first and second handle reinforcing panels 32*a*, 32*b* when folded about fold lines 33*a*, 33*b* respectively.

The blank 10 is folded, as indicated by direction arrow F2 in FIG. 2*c*, about fold lines 33*a*, 33*b* such that the first and second handle reinforcing panels 32*a*, 32*b* are brought into face contacting relationship with an inside surface of the first and second handle panels 30*a*, 30*b* respectively. The first handle reinforcing panel 32*a* is secured to the first handle panel 30*a*. The second handle reinforcing panel 32*b* is secured to the second handle panel 30*b*.

The blank 10 is folded, as indicated by direction arrow F3 in FIG. 2*c*, about fold line 51*d* such that the fourth partition panel 52*d* is brought into face contacting relationship with the second partition panel 52*a*. The fourth partition panel 52*d* is secured to the second partition panel 52*a*.

The blank 10 is folded, as indicated by direction arrow F4 in FIG. 2*c*, about fold line 51*c* such that the eighth partition panel 52*c* is brought into face contacting relationship with the sixth partition panel 52*b*. The eighth partition panel 52*c* is secured to the sixth partition panel 52*b*.

Glue G or other adhesive treatment is applied to an end portion of the fourth partition panel 52*d*, to an end portion of the eighth partition panel 52*c* and to end regions of the first and second handle reinforcing panels 32*a*, 32*b*, as shown in FIG. 2*c*.

Figure 2F:
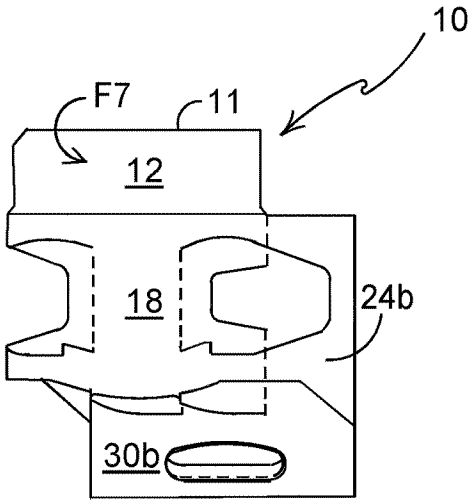
Figure 2E:
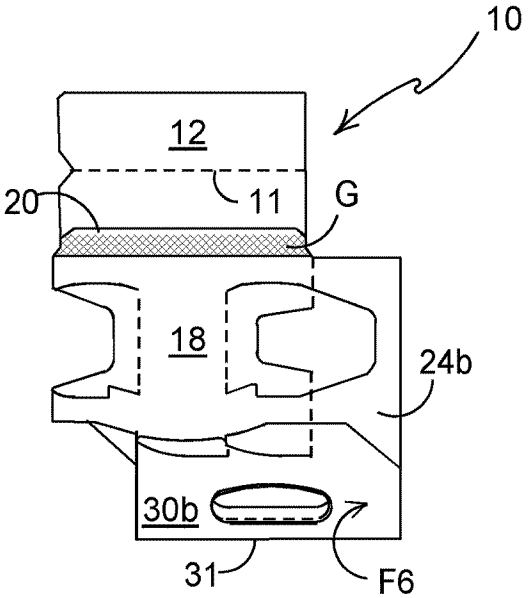
Figure 2D:
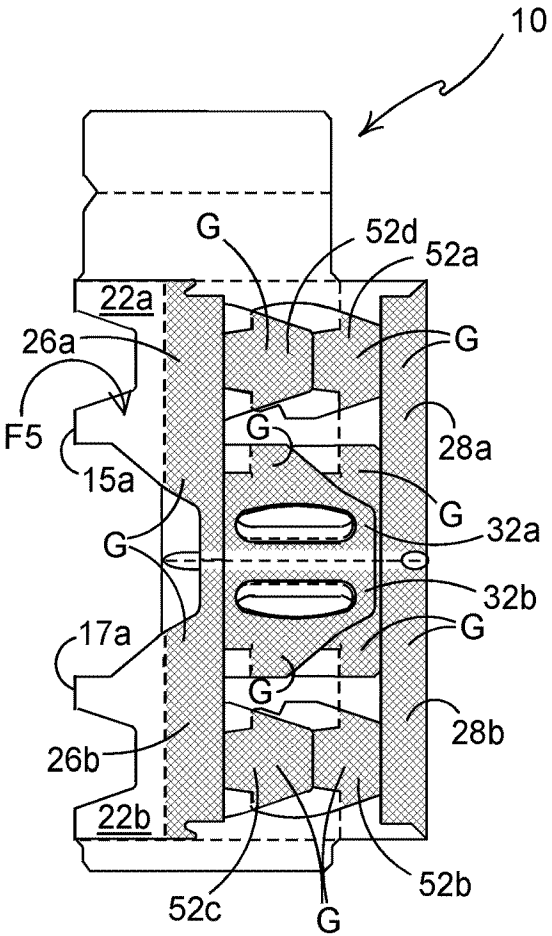

The blank 10 is folded, as indicated by direction arrow F5 in FIG. 2*d*, about fold lines 15*a*, 17*a* such that the first end panel 22*a* is brought into face contacting relationship with the first side panel 16, the third end panel 22*b* is brought into face contacting relationship with the second side panel 18, a portion of the first riser panel 26*a* is brought into face contacting relationship with the first handle reinforcing panel 32*a* and a portion of the third riser panel 26*b* is brought into face contacting relationship with the second handle reinforcing panel 32*b*. A portion of the first riser panel 26*a* is brought into face contacting relationship with the fourth partition panel 52*d*. A portion of the third riser panel 26*b* is brought into face contacting relationship with the eighth partition panel 52*c*. The first riser panel 26*a* is secured to the fourth partition panel 52*d*. The third riser panel 26*b* is secured to the eighth partition panel 52*c*. The first riser panel 26*a* is secured to the first handle reinforcing panel 32*a* and the third riser panel 26*b* is secured to the second handle reinforcing panel 32*b*.

Glue G or other adhesive treatment is applied to; the first riser panel 26*a*, the third riser panel 26*b*, the fourth partition panel 52*d*, the second partition panel 52*a*, the eighth partition panel 52*c*, the sixth partition panel 52*b*, the second riser panel 28*a*, the fourth riser panel 28*b*, the first handle reinforcing panel 32*a*, the second handle reinforcing panel 32*a*, the first handle panel 30*a*, the second handle panel 30*a*, as shown in FIG. 2*d*.

The blank 10 is folded, as indicated by direction arrow F6 in FIG. 2*e*, about fold line 31, (and about fold lines 43, 37, 41 which are disposed in overlying relationship with fold line 31) such that the second side panel 18 is disposed in overlying relationship with the first side panel 16. The second handle panel 30*b* and the second handle reinforcing panel 32*b* are disposed in overlying relationship with the first handle panel 30*a* and the first handle reinforcing panel 32*a*. The fourth end panel 24*b* is disposed in overlying relationship with the second end panel 24*a*.

Glue G or other adhesive treatment is applied to the securing panel 20.

The blank 10 is folded, as indicated by direction arrow F7 in FIG. 2*f*, about fold line 11 so as to fold the base panel 12 upon itself, a portion of the base panel 12 is brought into face contacting relationship with the securing panel 20 and secured thereto.

A flat collapsed carrier is formed as shown in FIG. 2*f*. The flat collapsed carrier may be shipped or distributed in this flat collapsed form.

The flat collapsed carrier may be erected into a tubular structure by separating the first side panel 16 from the second side panel 18. In this way a carrier 90 is formed as illustrated in FIG. 3, the carrier 90 has a plurality of cells each for receiving an article (not shown). The illustrated carrier 90 has 6 cells, three cells on each side of the carrying handle H.

In the erected condition the third recess R3 is received in the first and second recesses R1, R2 so as to interlock the base panel 12 with the first and third riser panels 26*a*, 26*b*. In this way the carrier 90 is locked in an erected condition.

The partition structures P1, P2, P3, P4 are automatically erected within the carrier 90 when the flat collapsed carrier is erected. The partition structures P1, P2, P3, P4 are automatically formed within the carrier in response to unfolding the flat collapsed folded blank, shown in FIG. 2*f*, when the carrier is erected. There is no requirement to provide specialist or complex tools to erect the partition structures. The erection flat collapsed folded blank can be readily automated.

The carrier 90, in its erected form, may be loaded with articles through the open top end of the carrier 90.

The carrier 90 comprises partition structures P1, P2, P3, P4 which are formed from material which would otherwise have formed the outer side or end walls of the carrier 90. The partition structures P1, P2, P3, P4 can be said to be struck from the outer walls of the carrier 90.

The partition structures P1, P2, P3, P4 are hinged to a respective one of the first or second side walls 16, 18. Each of the partition structures P1, P2, P3, P4 when erected forms a "T" shape. The lower end of each upright member of the "T" shapes (first, third, fifth and seventh partition panels 50*a*, 50*d*, 50*b*, 50*c*) are hinged to a respective one of the first or second side walls 16, 18. Each horizontal member of the "T" shapes (second, fourth, sixth and eighth partition panels 52*a*, 52*d*, 52*b*, 52*c*) is secured to a horizontal member of the "T" shape of an adjacent neighbour at one end of its horizontal member and to a respective one of the first, second, third or fourth riser panels 26*a*, 28*a*, 26*b*, 28*b* at the other end of its horizontal member.

The second partition panel 52*a* is secured to the sixth partition panel 52*b*. The fourth partition panel 52*d* is secured to the eighth partition panel 52*c*.

The second, fourth, sixth and eighth partition panels 52*a*, 52*d*, 52*b*, 52*c* divide the carrier longitudinally into two rows. The second, fourth, sixth and eighth partition panels 52*a*, 52*d*, 52*b*, 52*c* together couple the first and third riser panels 26*a*, 26*b* at a first end of the carrier 90 to the second and fourth riser panels 28*a*, 28*b* at a second, opposing end of the carrier 90.

The first connecting panel 42*a* extends between the first side panel 16 and the first handle reinforcing panel 32*a*. The first connecting panel 42*a* is disposed, substantially, in vertical registry, above, the third partition panel 50*d*.

The second connecting panel 42*b* extends between the first side panel 16 and the second handle panel 30*a*. The second connecting panel 42*b* is disposed, substantially, in vertical registry, above, the first partition panel 50*a*.

The third connecting panel 42*c* extends between the second side panel 18 and the second handle panel 30*b*. The third connecting panel 42*c* is disposed, substantially, in vertical registry, above, the fifth partition panel 50*b*.

The fourth connecting panel 42*d* extends between the second side panel 18 and the second handle reinforcing panel 32*b*. The fourth connecting panel 42*d* is disposed, substantially, in vertical registry, above, the seventh partition panel 50*c*.

The first connecting panel 42*a*, second connecting panel 42*b*, third connecting panel 42*c* and fourth connecting panel 42*d* serve to stabilise the panels 30*a*, 30*b*, 32*a*, 32*b* which form the carrying handle H in addition to dividing the carrier 90 in a transverse direction.

The outer walls of the carrier each comprise an outer surface and an inner surface, the second and fourth partition structures P2, P4 are folded such that the inner surface of the eighth partition panel 52*c* and the fourth partition panel 52*d* face the inner surface of the respective outer wall 16, 18 to which they are hingedly connected by seventh or third partition panel 50*c*, 50*d* respectively.

Referring now to FIGS. 6 to 10, there is shown an additional embodiment of the present disclosure. In the second illustrated embodiment, like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 5 will be described in detail.

The blank 110 comprises a plurality of main panels 112, 116, 118, 120, 122*a*, 122*b*, 124*a*, 124*b* for forming walls of the carrier. The blank 110 comprises a base panel 112 hinged to a first side panel 116 by a fold line 113. The first side panel 116 is hinged at a first end to a first end panel 122*a* by a fold line 115*a*. The first side panel 116 is hinged at a second end to a second end panel 124*a* by a fold line 115*b*. The blank 110 comprises a second side panel 118. The second side panel 118 is hinged at a first end to a third end panel 122*b* by a fold line 117*a*. The second side panel 118 is hinged at a second end to a fourth end panel 124*b* by a fold line 117*b*. A securing panel 120 is hinged to the second side panel 118 by a fold line 119.

The first end panel 122*a* and the third end panel 122*b* together form a first end wall of the carrier 190. The second end panel 124*a* and the fourth end panel 124*b* together form a second end wall of the carrier 190.

The blank 110 comprises a first riser panel 126*a* hinged to the first end panel 122*a* by a fold line 125*a*. The blank 110 comprises a second riser panel 128*a* hinged to the second end panel 124*a* by a fold line 127*a*. The blank 110 comprises a third riser panel 126*b* hinged to the third end panel 122*b* by a fold line 125*b*. The blank 110 comprises a fourth riser panel 128*b* hinged to the fourth end panel 124*b* by a fold line 127*b*. The first riser panel 126*a* is hinged to the third riser panel 126*b* by a fold line 143. The second riser panel 128*a* is hinged to the fourth riser panel 128*b* by a fold line 141. Optionally, the fold line 141 is interrupted by an aperture A6 which is struck in part from the second riser panel 128*a* and in part from the fourth riser panel 128*b*.

The first riser panel 126*a* comprises a first recess R1 which is configured to form a hook like projection on a side edge thereof. The third riser panel 126*b* comprises a second recess R2 which is configured to form a hook like projection on a side edge thereof.

The second riser panel 128*a* comprises a fourth recess R4 which is configured to form a hook like projection on a side edge thereof. The fourth riser panel 128*b* comprises a fifth recess R5 which is configured to form a hook like projection on a side edge thereof.

The base panel 112 comprises a fold line 111 which extends longitudinally thereacross so as to longitudinally bisect the base panel 112. The base panel 112 comprises a third recess R3 struck from a first end edge thereof; the fold line 111 extends from the third recess R3. The third recess R3 is configured to form a notch for interlocking with the hook like projections formed by the first and second recesses R1, R2 in the first riser panel 126*a* and the third riser panel 126*b* respectively.

The base panel 112 comprises a sixth recess R6 struck from a second end edge thereof; the fold line 111 extends between the sixth recess R6 and the third recess R3. The sixth recess R6 is configured to form a notch for interlocking with the hook like projections formed by the fourth and fifth recesses R4, R5 in the second riser panel 128*a* and the fourth riser panel 128*b*.

The blank 110 comprises a plurality of partition structures P1, P2, P3, P4. A first partition structure P1 is formed in part from the first side panel 116 and in part from the second end panel 124*a*.

A second partition structure P2 is formed in part from the first side panel 116 and in part from the first end panel 122*a*.

A third partition structure P3 is formed in part from the second side panel 118 and in part from the fourth end panel 124*b*.

A fourth partition structure P4 is formed in part from the second side panel 118 and in part from the third end panel 122*b*.

The first partition structure P1 comprises a first partition panel 150*a* struck from the first side panel 116 and a second partition panel 152*a* struck from the second end panel 124*a*. The first partition panel 150*a* is hinged to the first side panel 116 by a fold line 151*a*. The second partition panel 152*a* is hinged to the first partition panel 150*a* by a fold line 153*a*. The fold line 153*a* is collinear with the fold line 115*b* between the first side panel 116 and the second end panel 124*a*. The second partition panel 152*a* is hinged to the second riser panel 128*a* by a fold line 155*a*. The fold line 155*a* is collinear with the fold line 127*a* between the second end panel 124*a* and the second riser panel 128*a*.

The second partition structure P2 comprises a third partition panel 150*d* struck from the first side panel 116 and a fourth partition panel 152*d* struck in part from the first end panel 122*a* and in part from the first riser panel 126*a*. The third partition panel 150*d* is hinged to the first side panel 116 by a fold line 151*d*. The fourth partition panel 152*d* is hinged to the third partition panel 150*d* by a fold line 153*d*. The fold line 153*d* is collinear with the fold line 115*a* between the first side panel 116 and the first end panel 122*a*.

The third partition structure P3 comprises a fifth partition panel 150*b* struck from the second side panel 118 and a sixth partition panel 152*b* struck from the fourth end panel 124*b*. The third partition structure P3 is substantially similar in structure to the first partition structure P1 and will not be described in further detail.

The fourth partition structure P4 comprises a seventh partition panel 150*c* struck from the second side panel 118 and an eighth partition panel 152*c* struck in part from the second side panel 118 and in part from the third riser panel 126*b*. The fourth partition structure P4 is substantially similar in structure to the second partition structure P2 and will not be described in further detail.

Turning to the construction of the carrier 190 as illustrated in FIGS. 7*a* to 7*f*, the carrier 190 can be formed by a series of sequential folding operations in a straight line machine so that the carrier 190 is not required to be rotated or inverted to complete its construction. The folding process is not limited to that described below and may be altered according to particular manufacturing requirements.

Figures 7A, 7B, 7C:
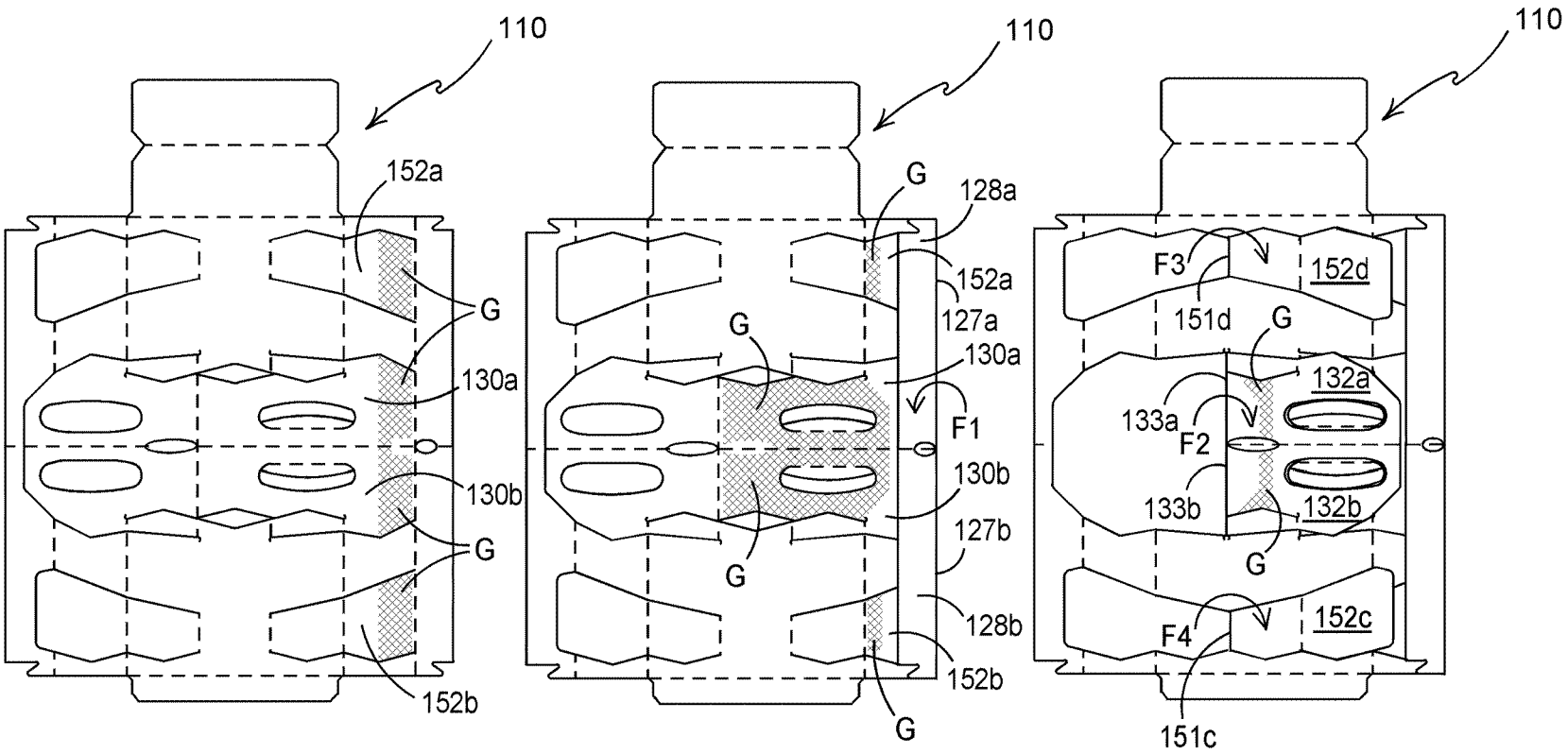
FIGS. 7*a* to 7*f* are plan views from above of stages of construction of the blank of FIG. 6.

Glue G or other adhesive treatment is applied to a first end portion of the second partition panel 152*a*, to a first end portion of the sixth partition panel 152*b* and to end regions of the first and second handle panels 130*a*, 130*b*, as shown in FIG. 7*a*.

The blank 110 is folded, as shown in FIG. 7*b* by direction arrow F1, about fold lines 127*a* and 127*b* such that the second riser panel 128*a* and the fourth riser panel 128*b* are brought into face contacting relationship with each of the second end panel 124*a*, the fourth end panel 124*b*, the first and second handle panels 130*a*, 130*b* and the second and sixth partition panels 152*a*, 152*b*. The second riser panel 128*a* is secured to the first handle panel 130*a* and the second partition panel 152*a*. The fourth riser panel 128*b* is secured to the second handle panel 130*b* and the sixth partition panel 152*b*.

Glue G or other adhesive treatment is applied to a second end portion—adjacent fold line 153*a*—of the second partition panel 152*a*, to a second end portion—adjacent fold line 153*b*—of the sixth partition panel 152*b*. The second end portions of the second and sixth partition panels 152*a*, 152*b* are opposed to the respective first end portions of the second and sixth partition panels 152*a*, 152*b*. Glue or other adhesive treatment is applied to a region of each of the first and second handle panels 130*a*, 130*b*, as shown in FIG. 7*b*. The region of the first and second handle panels 130*a*, 130*b* to which glue or other adhesive treatment is applied corresponds to those portions of the first and second handle panels 130*a*, 130*b* which will be in face contacting relationship with the respective one of the first and second handle reinforcing panels 132*a*, 132*b* when folded about fold lines 133*a*, 133*b* respectively.

The blank 10 is folded, as indicated by direction arrow F2 in FIG. 7*c*, about fold lines 133*a*, 133*b* such that the first and second handle reinforcing panels 132*a*, 132*b* are brought into face contacting relationship with an inside surface of the first and second handle panels 130*a*, 130*b* respectively. The first handle reinforcing panel 132*a* is secured to the first handle panel 130*a*. The second handle reinforcing panel 132*b* is secured to the second handle panel 130*b*.

The blank 110 is folded, as indicated by direction arrow F3 in FIG. 7*c*, about fold line 151*d* such that the fourth partition panel 152*d* is brought into face contacting relationship with the second partition panel 152*a*. The fourth partition panel 152*d* is secured to the second partition panel 152*a*.

The blank 110 is folded, as indicated by direction arrow F4 in FIG. 7*c*, about fold line 151*c* such that the eighth partition panel 152*c* is brought into face contacting relationship with the sixth partition panel 152*b*. The eighth partition panel 152*c* is secured to the sixth partition panel 152*b*.

Glue G or other adhesive treatment is applied to end regions of the first and second handle reinforcing panels 132*a*, 132*b*, as shown in FIG. 7*c*. The end regions of the first and second handle reinforcing panels 132*a*, 132*b* to which glue or other adhesive treatment is applied corresponds to those portions of the first and third riser panels 126*a*, 126*b* which will be in face contacting relationship with the respective one of the first and second handle reinforcing panels 132*a*, 132*b* when the blank 110 is folded about the fold line 115*a* and the fold line 117*a*.

Figure 7F:
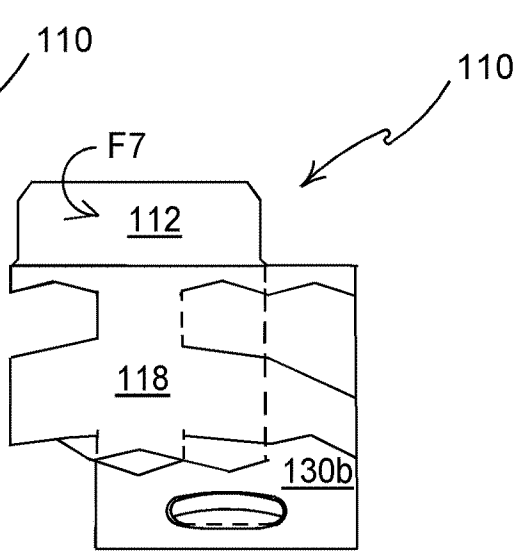
Figure 7E:
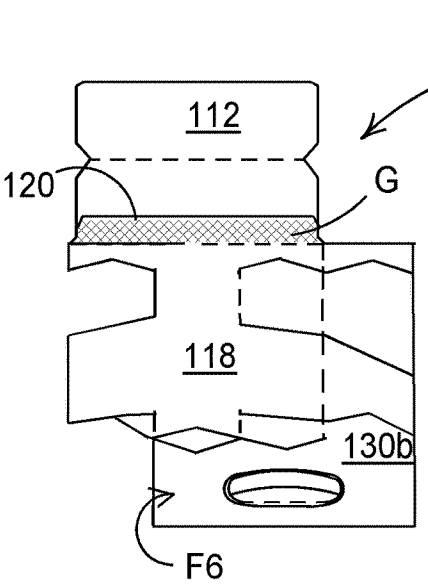
Figure 7D:
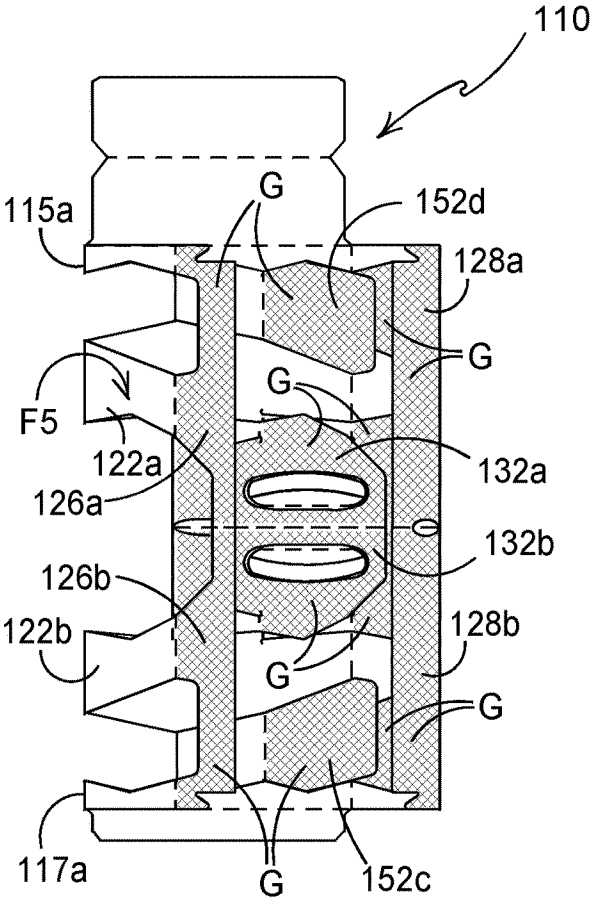

The blank 110 is folded, as indicated by direction arrow F5 in FIG. 7*d*, about fold lines 115*a*, 117*a* such that first end panel 122*a* is brought into face contacting relationship with the first side panel 116, the third end panel 122*b* is brought into face contacting relationship with the second side panel 118, a portion of the first riser panel 126*a* is brought into face contacting relationship with the first handle reinforcing panel 132*a* and a portion of the third riser panel 126*b* is brought into face contacting relationship with the second handle reinforcing panel 132*b*. The first riser panel 126*a* is secured to the first handle reinforcing panel 132*a* and the third riser panel 126*b* is secured to the second handle reinforcing panel 132*b*.

Glue G or other adhesive treatment is applied to; the first riser panel 126*a*, the third riser panel 126*b*, the fourth partition panel 152*d*, the second partition panel 152*a*, the eighth partition panel 152*c*, the sixth partition panel 152*b*, the second riser panel 128*a*, the fourth riser panel 128*b*, the first handle reinforcing panel 132*a*, the second handle reinforcing panel 132*b*, the first handle panel 130*a*, the second handle panel 130*b*, as shown in FIG. 7*d*.

The blank 110 is folded, as indicated by direction arrow F6 in FIG. 7*e*, about fold line 131, (and about fold lines 143, 137, 141 which are disposed in overlying relationship with fold line 131) such that the second side panel 118 is disposed in overlying relationship with the first side panel 116. The second handle panel 130*b* and the second handle reinforcing panel 132*b* are disposed in overlying relationship with the first handle panel 130*a* and the first handle reinforcing panel 132*a*. The fourth end panel 124*b* is disposed in overlying relationship with the second end panel 124*a*.

Glue G or other adhesive treatment is applied to the securing panel 120.

The blank 110 is folded, as indicated by direction arrow F7 in FIG. 7*f*, about fold line 111 so as to fold the base panel 112 upon itself, a portion of the base panel 112 is brought into face contacting relationship with the securing panel 120 and secured thereto.

A flat collapsed carrier is formed as shown in FIG. 7*f*. The flat collapsed carrier may be shipped or distributed in this flat collapsed form.

Figure 8:
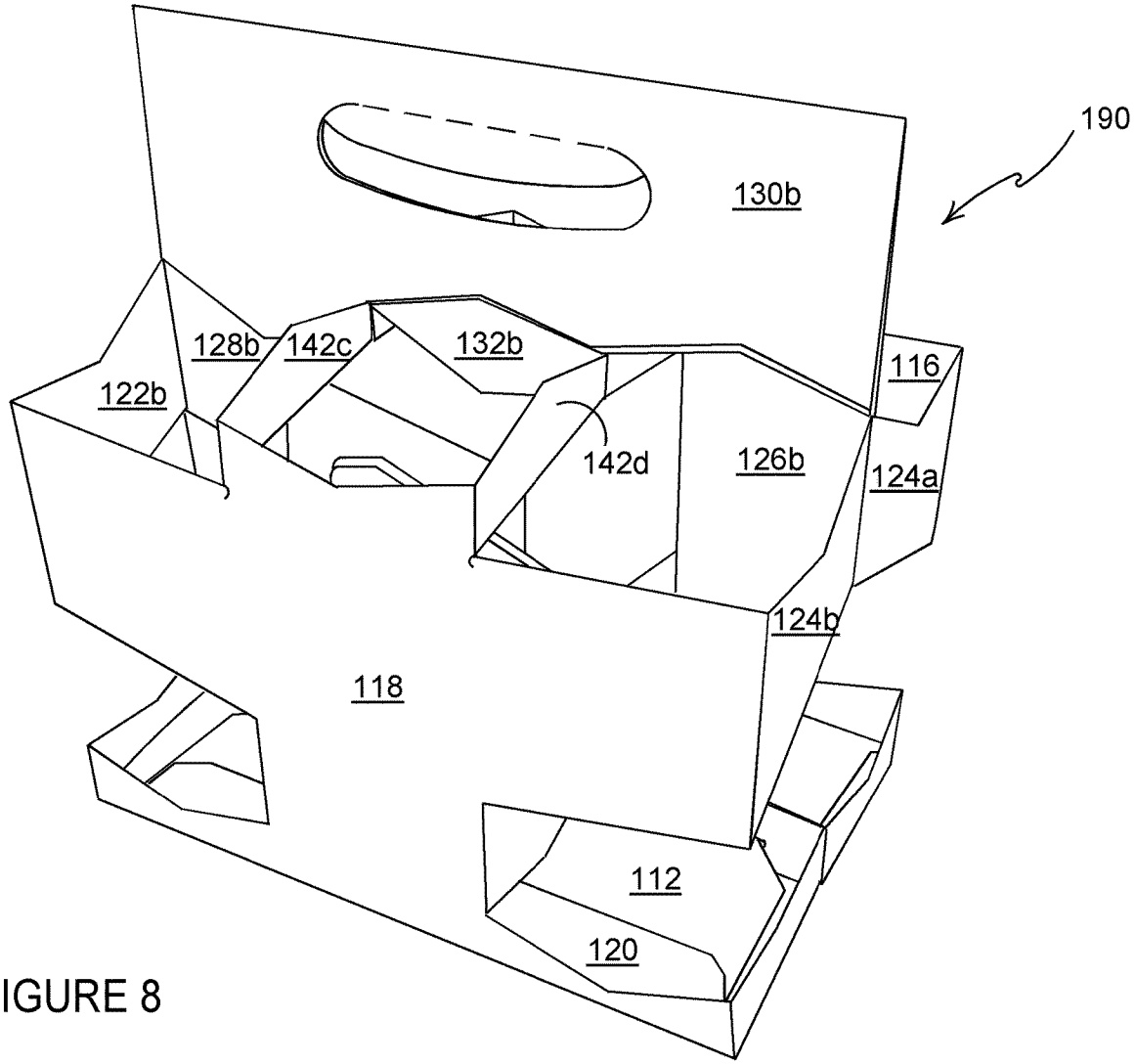
FIG. 8 is a perspective view from above of a carrier formed from the blank of FIG. 6.
Figure 9:
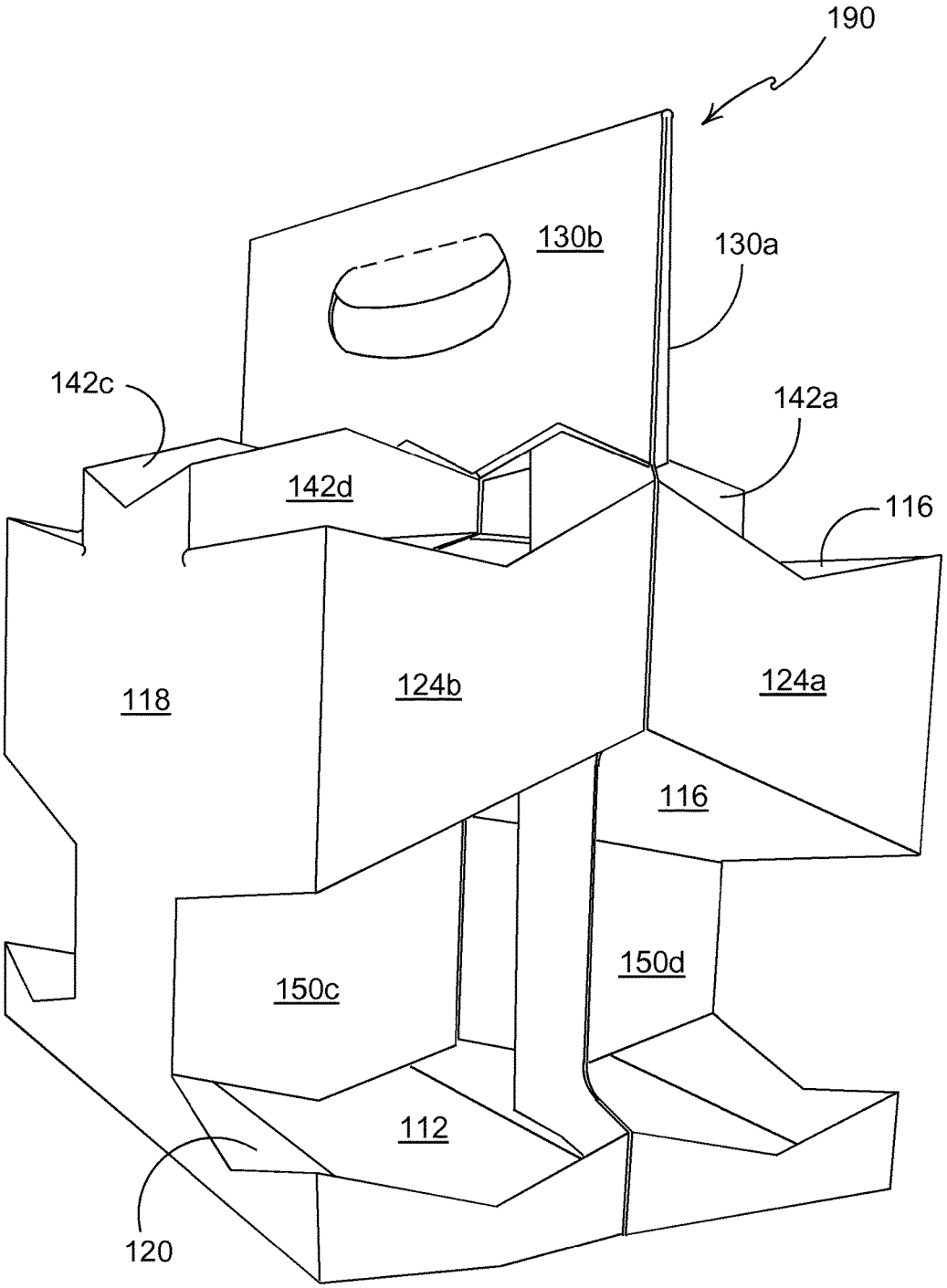
FIG. 9 is an alternative perspective view from above of the carrier FIG. 8.
Figure 10:
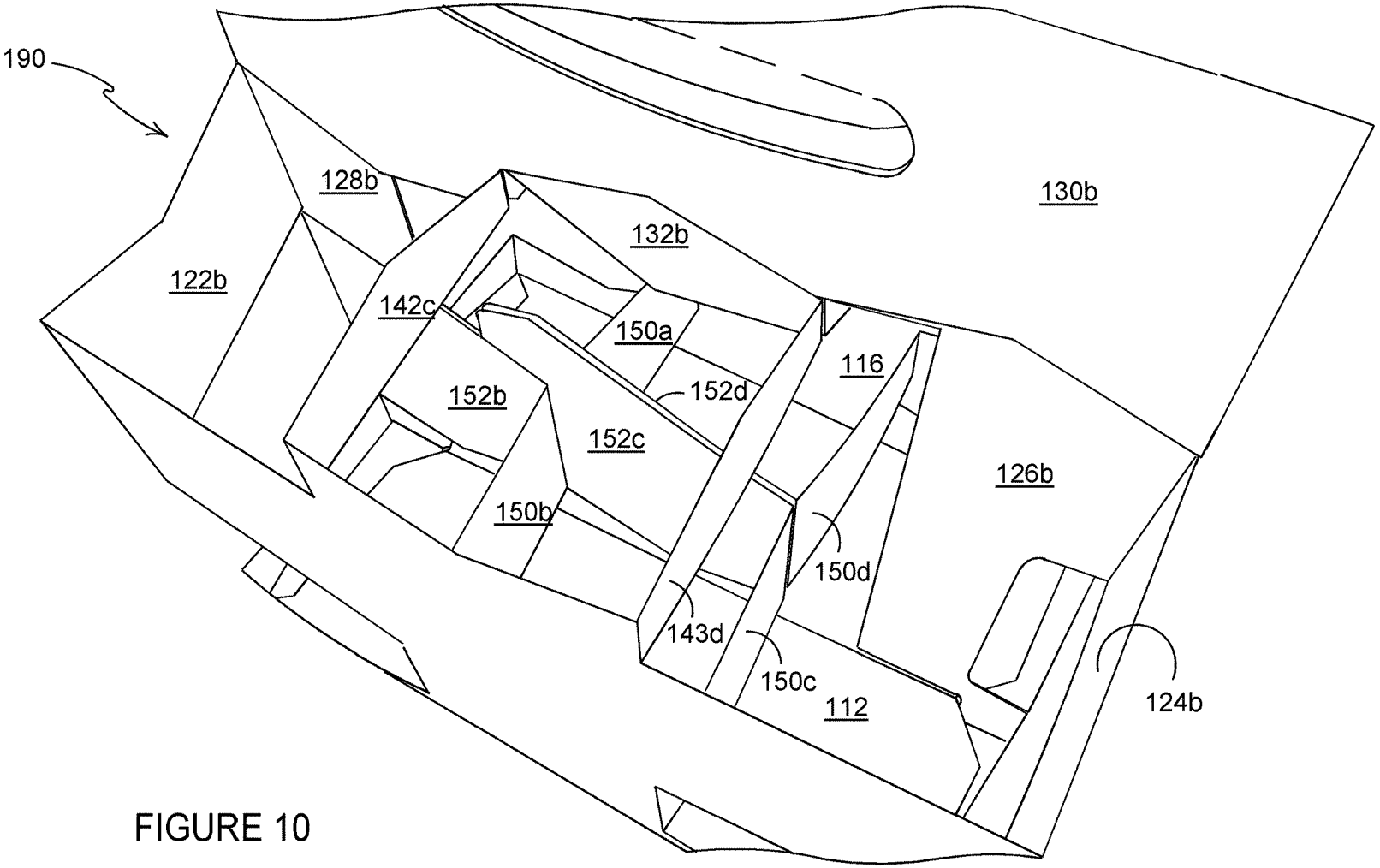
FIG. 10 is a perspective view from above of a portion of the carrier formed from the blank of FIG. 6 showing an internal cellular structure.
Figure 11:
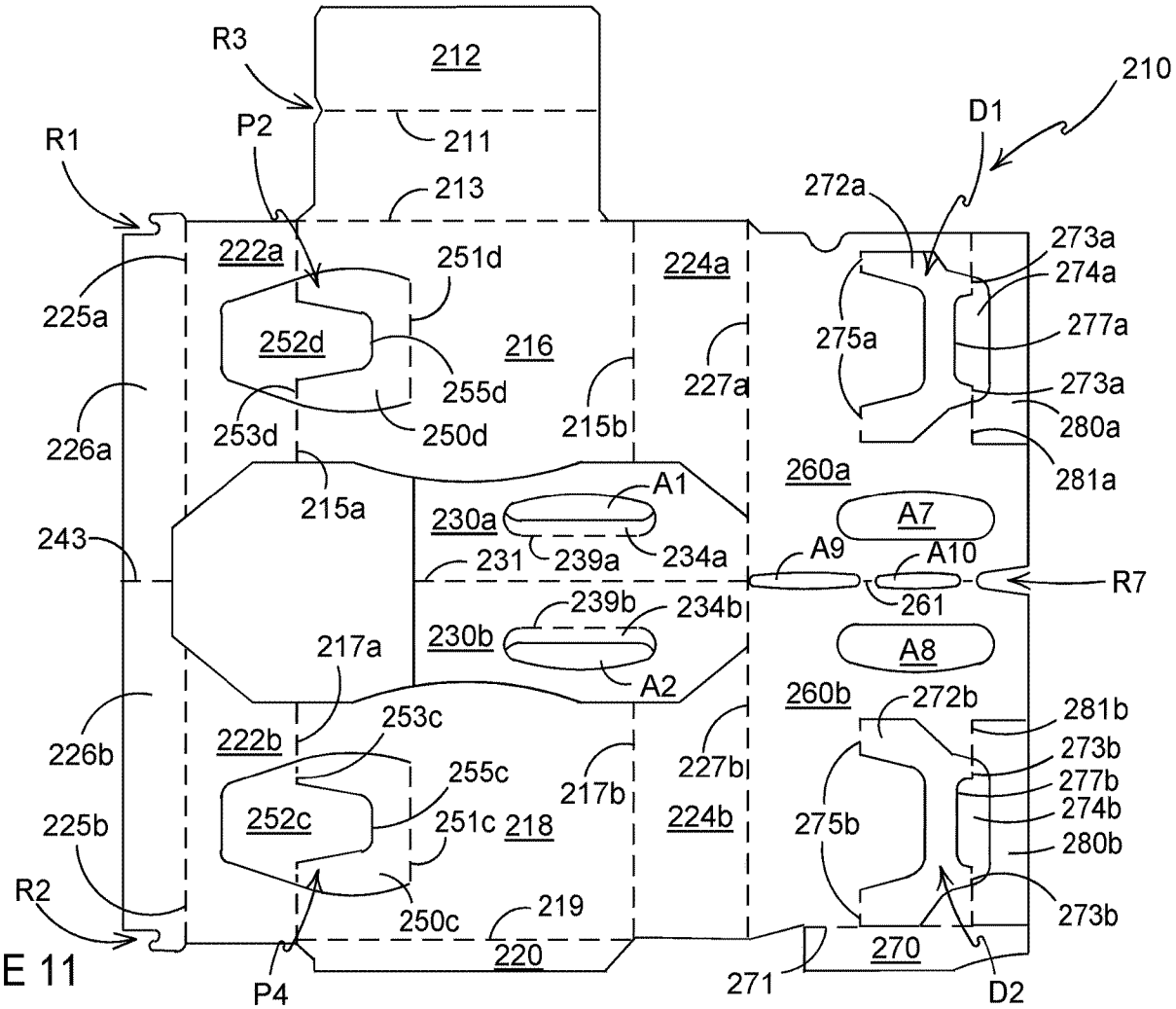
FIG. 11 is a plan view from above of a blank for forming a carrier according to a third embodiment.

The flat collapsed carrier may be erected into a tubular structure by separating the first side panel 116 from the second side panel 118. In this way a carrier 190 is formed as illustrated in FIG. 8, the carrier 190 has a plurality of cells each for receiving an article (not shown). The illustrated carrier 190 has 6 cells, three cells on each side of the carrying handle H.

In the erected condition the third recess R3 is received in the first and second recesses R1, R2 so as to interlock the base panel 112 with the first and third riser panels 126*a*, 126*b*. The sixth recess R6 is received in the fourth and fifth recesses R4, R5 so as to interlock the base panel 112 with the second and fourth riser panels 128*a*, 128*b*. In this way the carrier 190 is locked in an erected condition.

The partition structures P1, P2, P3, P4 are automatically erected within the carrier 190 when the flat collapsed carrier is erected. The carrier 190, in its erected form, may be loaded with articles through the open top end of the carrier 190.

The partition structures P1, P2, P3, P4 are hinged to a respective one of the first or second side walls 116, 118. Each of the first and second partition structures P1, P2, when viewed from above forms an "L" shape. Each of the third and fourth partition structures P3, P4, when viewed from below forms an "L" shape. The base member of the "L" shapes (first, third, fifth and seventh partition panels 150*a*, 150*d*, 150*b*, 150*c*) are hinged to a respective one of the first or second side walls 116, 118. Each of the upright member of the "L" shapes (second, fourth, sixth and eighth partition panels 152*a*, 152*d*, 152*b*, 152*c*) is folded towards a first end of the carrier defined by the second and fourth riser panels 128*a*, 128*b*.

The upright member of the "L" shapes of the second and fourth partition structures P2, P4 are secured to one another, that is to say the fourth partition panel 152*d* is secured to the eighth partition panel 152*c*.

An end portion of each of the fourth partition panel 152*d* and the eighth partition panel 152*c* is secured between a portion of each of the second and sixth partition panels 152*a*, 152*b*. A portion of the second partition panel 152*a* is secured to a portion of the sixth partition panel 152*b*.

The second and fourth riser panels 128*a*, 128*b* are secured between the second and sixth partition panels 152*a*, 152*b*.

The sixth partition panel 152*b* is hinged to the fourth riser panel 128*b* and the second partition panel 152*b* is hinged to the second riser panels 128*a*.

The first and third riser panels 126*a*, 126*b* are independent of the partition structures P1, P2, P3, P4 that is to say they are free from or unsecured to the partition structures P1, P2, P3, P4.

The second, fourth, sixth and eighth partition panels 152*a*, 152*d*, 152*b*, 152*c* substantially divide the carrier longitudinally into two rows.

The first, third, fifth and seventh partition panels 150*a*, 150*d*, 150*b*, 150*c* divide the carrier transversely into three columns.

The outer walls of the carrier each comprise an outer surface and an inner surface, the second and fourth partition structures P2, P4 are folded such that the inner surface of the eighth partition panel 152*c* and the fourth partition panel 152*d* face the inner surface of the respective outer wall 116, 118 to which they are hingedly connected by seventh or third partition panel 150*c*, 150*d* respectively. The second and fourth partition structures P2, P4 are struck in part from the first or third riser panels 126*a*, 126*b* respectively, the first or third riser panels 126*a*, 126*b* form, at least in part, an intermediate wall in the carrier 190 which segregates the carrier at least in part in a first direction.

The eighth partition panel 152*c* and the fourth partition panel 152*d* are hinged at a first end edge to a respective one of the seventh or third partition panels 150*c*, 150*d*. The eighth partition panel 152*c* and the fourth partition panel 152*d* each comprises a second free end edge, the second free end edge opposes the respective first end edge.

Referring now to FIGS. 11 to 14, there is shown an additional embodiment of the present disclosure. In the third illustrated embodiment, like numerals have, where possible, been used to denote like parts, albeit with the addition of the prefix "200" to indicate that these features belong to the third embodiment. The additional embodiment shares many common features with the first and second embodiments and therefore only the differences from the embodiments illustrated in FIGS. 1 to 10 will be described in detail.

The blank 210 comprises a plurality of main panels 212, 216, 218, 220, 222*a*, 222*b*, 224*a*, 224*b* for forming walls of the carrier. The blank 210 comprises a base panel 212 hinged to a first side panel 216 by a fold line 213. The first side panel 216 is hinged at a first end to a first end panel 222*a* by a fold line 215*a*. The first side panel 216 is hinged at a second end to a second end panel 224*a* by a fold line 215*b*. The blank 210 comprises a second side panel 218. The second side panel 218 is hinged at a first end to a third end panel 222*b* by a fold line 217*a*. The second side panel 218 is hinged at a second end to a fourth end panel 224*b* by a fold line 217*b*. A securing panel 220 is hinged to the second side panel 218 by a fold line 219.

The blank 210 comprises a first riser panel 226*a* hinged to the first end panel 222*a* by a fold line 225*a*. The blank 210 comprises a third riser panel 226*a* hinged to the third end panel 222*b* by a fold line 225*b*. The first riser panel 226*a* is hinged to the third riser panel 226*b* by a fold line 243.

The blank 210 comprises a first divider panel 260*a* hinged to the second end panel 224*a* by a fold line 227*a*. The blank 210 comprises a second divider panel 260*b* hinged to the fourth end panel 224*b* by a fold line 227*b*. The first divider panel 260*a* is hinged to the second divider panel 260*b* by a fold line 261. Optionally, the fold line 261 is interrupted by apertures A9, A10 and a recess or cutaway R7 each of which is struck in part from the first divider panel 260*a* and in part from the second divider panel 260*b*.

The first divider panel 260*a* includes a fifth handle aperture A7; an upper region—in a set up carrier 290—of the first divider panel 260*a* serves to reinforce the carrying handle H formed by the first and second handle panels 230*a*, 230*b*.

The second divider panel 260*b* includes a sixth handle aperture A8; an upper region—in a set up carrier 290—of the second divider panel 260*b* serves to reinforce the carrying handle H formed by the first and second handle panels 230*a*, 230*b*.

A lower region—in a set up carrier 290—of the first divider panel 260*a* provides a first partition structure D1. The first partition structure D1 is struck from the lower region of the first divider panel 260*a* and provides a transverse cell divider. The first partition structure D1 comprises a first partition panel 272*a* hinged to the first divider panel 260*a* by fold line 275*a*, the fold line 275*a* is interrupted by a substantially "U" shaped cut line or severance line. A first glue panel 274*a* is hinged to the first partition panel 272*a* by a fold line 273*a*, the fold line 273*a* is interrupted by a substantially "U" shaped cut line or severance line 277*a*.

A second partition structure P2 is formed in part from the first side panel 216 and in part from the first end panel 222*a*. The second partition structure P2 comprises a third partition panel 250*d* struck from the first side panel 216 and a fourth partition panel 252*d* struck from the first end panel 222*a*. Optionally, the fourth partition panel 252*d* is struck in part from the first side panel 216 and/or the third partition panel 250*d*. The third partition panel 250*d* is hinged to the fourth partition panel 252*d* by a fold line 253*d*. The fold line 253*d* is interrupted by a cutline or severance line 255*d*. Outline 255*d* is substantially "C" shaped or "U" shaped. The third partition panel 250*d* is hinged to the first side panel 216 by a fold line 251*d*.

A lower region—in a set up carrier 290—of the second divider panel 260*b* provides a third partition structure D2. The third partition structure D2 is struck from the lower region of the second divider panel 260*b* and provides a transverse cell divider. The third partition structure D2 comprises a fifth partition panel 272*b* hinged to the second divider panel 260*b* by fold line 275*b*, the fold line 275*b* is interrupted by a substantially "U" shaped cut line or severance line. A second glue panel 274*b* is hinged to the fifth partition panel 272*b* by a fold line 273*b*, the fold line 273*b* is interrupted by a substantially "U" shaped cut line or severance line 277*b*.

A fourth partition structure P4 is formed in part from the second side panel 218 and in part from the third end panel 222*b*. The fourth partition structure P4 comprises a seventh partition panel 250*c* struck from the second side panel 218 and an eighth partition panel 252*c* struck from the third end panel 222*b*. Optionally, the eighth partition panel 252*c* is struck in part from the second side panel 218 and/or the seventh partition panel 250*c* and struck in part. The seventh partition panel 250*c* is hinged to the eighth partition panel 252*c* by a fold line 253*c*. The fold line 253*c* is interrupted by a cutline or severance line 255*c*. Outline 255*c* is substantially "C" shaped or "U" shaped. The seventh partition panel 250*c* is hinged to the second side panel 218 by a fold line 251*c*.

The first divider panel 260*a* and the second divider panel 260*b* serve to provide a longitudinal partition, the longitudinal partition extends partially across the longitudinal dimension of the carrier 290.

The first divider panel 260*a* comprises a third partition panel reinforcing panel 280*a*. The third partition panel reinforcing panel 280*a* is struck from the first divider panel

260*a* and is hinged thereto by a fold line 281*a*. Optionally, the first glue panel 274*a* is struck from the third partition panel reinforcing panel 280*a*, and fold line 281*a* may be collinear with fold line 273*a*.

The second divider panel 260*b* comprises a seventh partition panel reinforcing panel 280*b*. The seventh partition panel reinforcing panel 280*b* is struck from the second divider panel 260*b* and is hinged thereto by a fold line 281*b*. Optionally, the second glue panel 274*b* is struck from the seventh partition panel reinforcing panel 280*b*, and fold line 281*b* may be collinear with fold line 273*b*.

A support panel 270 is hinged to the lower edge of the second divider panel 260*b*. The support panel 270 supports the lower end of the seventh partition panel reinforcing panel 280*b*; this is required because the fifth partition panel 272*b* extends to the lower edge of the second divider panel 260*b* so as to separate the lower end of the seventh partition panel reinforcing panel 280*b* from the second divider panel 260*b*. In alternative embodiments, the support panel 270 may be omitted if a portion of the second divider panel 260*b* is provided below the fifth partition panel 272*b*, in a similar manner to that shown in respect of the first divider panel 260*a* and first partition panel 272*a*. In yet other embodiments a support panel may be hinged to a lower edge—in a set up condition—if the first partition panel 272*a* is arranged in a similar manner to the fifth partition panel 272*b*, that is to say the first partition panel 272*a* extends to the lower edge of the first divider panel 260*a*.

The first riser panel 226*a* comprises a first recess R1 which is configured to form a hook like projection on a side edge thereof. The third riser panel 226*b* comprises a second recess R2 which is configured to form a hook like projection on a side edge thereof.

Turning to the construction of the carrier 290 as illustrated in FIGS. 12*a* to 12*g*, the carrier 290 can be formed by a series of sequential folding operations in a straight line machine so that the carrier 290 is not required to be rotated or inverted to complete its construction. The folding process is not limited to that described below and may be altered according to particular manufacturing requirements.

Figures 12A, 12B, 12C:
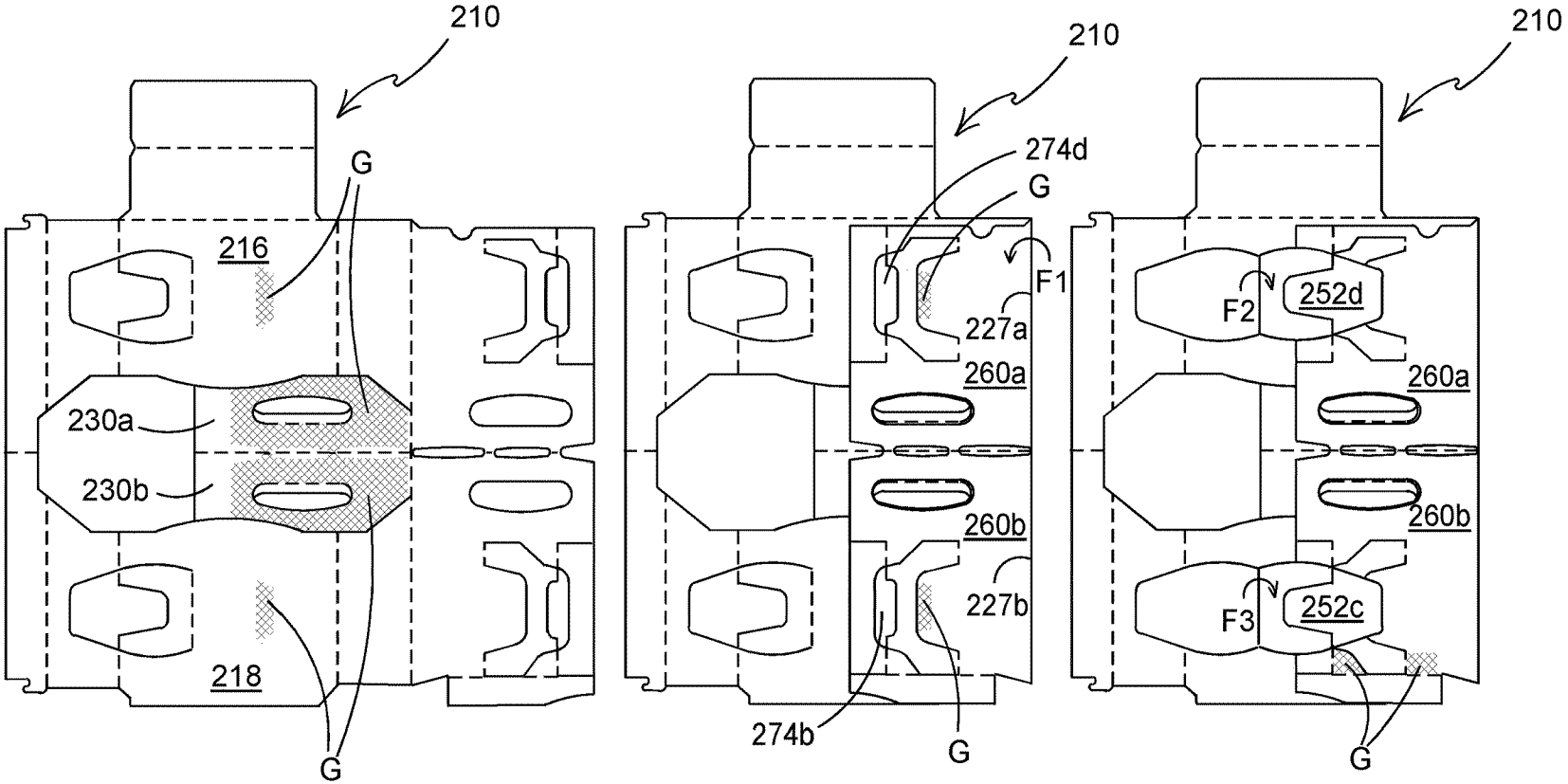
FIGS. 12*a* to 12*g* are plan views from above of stages of construction of the blank of FIG. 11.

Glue G or other adhesive treatment is applied to a region of the first side panel 216, to a region of the second side panel 218 and to end regions of the first and second handle panels 230*a*, 230*b*, as shown in FIG. 12*a*. The region of the first side panel 216 to which glue is applied corresponds to a portion which will be brought into contact with the first glue panel 274*a* when the blank 210 is folded about fold lines 227*a*, 227*b*. The region of the second side panel 218 to which glue is applied corresponds to a portion which will be brought into contact with the second glue panel 274*b* when the blank 210 is folded about fold lines 227*a*, 227*b*. The end regions of the first and second handle panels 230*a*, 230*b* to which glue is applied correspond to portions which will be brought into contact with the respective one of the first and second divider panels 260*a*, 260*b* when the blank 210 is folded about fold lines 227*a*, 227*b*.

The blank 210 is folded, as shown in FIG. 12*b* by direction arrow F1, about fold lines 227*a* and 227*b* such that the first and second divider panels 260*a*, 260*b* are brought into face contacting relationship with each of the second end panel 224*a*, the fourth end panel 224*b*, the first and second handle panels 230*a*, 230*b* and the first and second side panels 216, 218.

Optionally, glue G or other adhesive treatment may be applied to the third partition panel reinforcing panel 280*a* and to the seventh partition panel reinforcing panel 280*b* prior to folding the blank 210 about fold lines 227*a* and 227*b*, in this way the third partition panel reinforcing panel 280*a* and the seventh partition panel reinforcing panel 280*b* may be secured to third partition panel 250*d* and the seventh partition panel 250*c* respectively.

The first divider panel 260*a* is secured to the first handle panel 230*a*. The first side panel 216 is secured to the first glue panel 274*a*. The second divider panel 260*b* is secured to the second handle panel 230*b*. The second side panel 218 is secured to the second glue panel 274*b*.

Glue G or other adhesive treatment is applied to a portion of the first divider panel 260*a* adjacent cut line 277*a* and to a portion of the second divider panel 260*b* adjacent cut line 277*b*, as shown in FIG. 12*b*.

The blank 210 is folded, as indicated by direction arrow F2 in FIG. 12*c*; about fold line 251*d* such that the fourth partition panel 252*d* is brought into face contacting relationship with the first divider panel 260*a*. The fourth partition panel 252*d* is secured to the first divider panel 260*a*.

The blank 210 is folded, as indicated by direction arrow F3 in FIG. 12*c*, about fold line 251*c* such that the eighth partition panel 252*c* is brought into face contacting relationship with the second divider panel 260*b*. The eighth partition panel 252*c* is secured to the second divider panel 260*b*.

Glue G or other adhesive treatment is applied to lower regions of the second divider panel 260*b*. The lower regions of the second divider panel 260*b* to which glue or other adhesive treatment is applied corresponds to those portions of the second divider panel 260*b* which will be in face contacting relationship with the support panel 270 when the blank 210 is folded about the fold line 271.

Figures 12D, 12E, 12F, 12G:
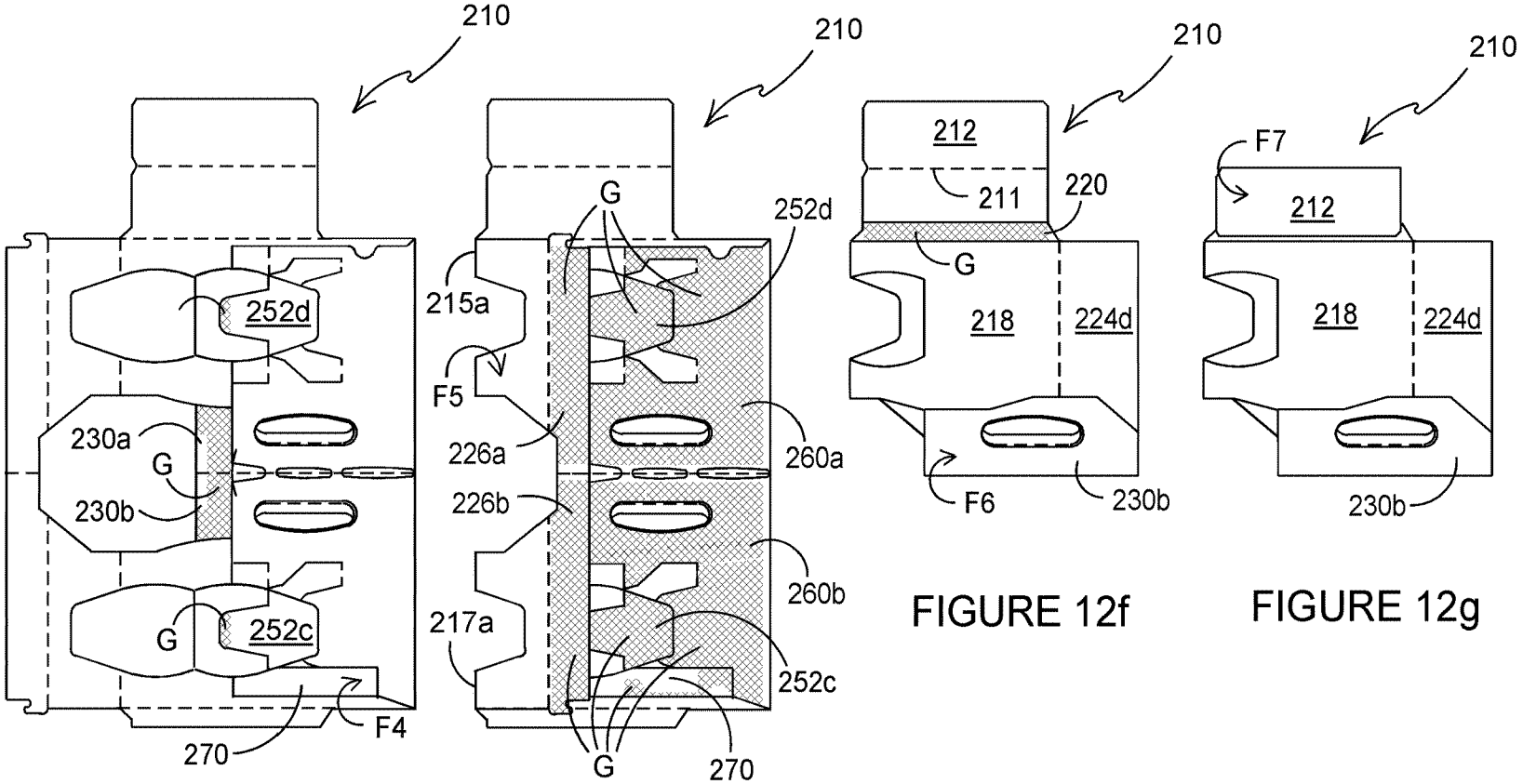

The blank 210 is folded, as indicated by direction arrow F4 in FIG. 12*d*, about fold line 271 such that the support panel 270 is brought into face contacting relationship with the second divider panel 260*b*. The support panel 270 is secured to the second divider panel 260*b*.

Glue G or other adhesive treatment is applied to; the fourth partition panel 252*d*, the eighth partition panel 252*c*, the first handle panel 230*a* and the second handle panel 230*b*, as shown in FIG. 12*d*.

The blank 210 is folded, as indicated by direction arrow F5 in FIG. 12*e*, about fold lines 215*a*, 217*a*. The first end panel 222*a* is brought into overlying relationship with the first side panel 216. The third end panel 222*b* is brought into overlying relationship with the second side panel 218. The first riser panel 226*a* is brought into face contacting relationship with the first handle panel 230*a* and the fourth partition panel 252*d*. The first riser panel 226*a* is secured to the first handle panel 230*a* and the fourth partition panel 252*d*. The third riser panel 226*b* is brought into face contacting relationship with the second handle panel 230*b* and the eighth partition panel 252*c*. The third riser panel 226*b* is secured to the second handle panel 230*b* and the eighth partition panel 252*c*.

Glue G or other adhesive treatment is applied to; the first riser panel 226*a*, third riser panel 226*b*, the fourth partition panel 252*d*, the eighth partition panel 252*c*, the first divider panel 260*a* and the second divider panel 260*b*, as shown in FIG. 12*e*.

The blank 210 is folded, as indicated by direction arrow F6 in FIG. 12*f*, about fold lines 231, (and about fold lines 243, 261 which are disposed in overlying relationship with fold line 231) such that the second side panel 218 is disposed in overlying relationship with the first side panel 216. The second handle panel 230*b* is disposed in overlying relationship with the first handle panel 230*a*. The fourth end panel 224*b* is disposed in overlying relationship with the second end panel 224*a*.

Glue G or other adhesive treatment is applied to the securing panel 220.

The blank 210 is folded, as indicated by direction arrow F7 in FIG. 12*g*, about fold line 211 so as to fold the base panel 212 upon itself, a portion of the base panel 212 is brought into face contacting relationship with the securing panel 220 and secured thereto.

A flat collapsed carrier is formed as shown in FIG. 12*g*. The flat collapsed carrier may be shipped or distributed in this flat collapsed form.

Figure 13:
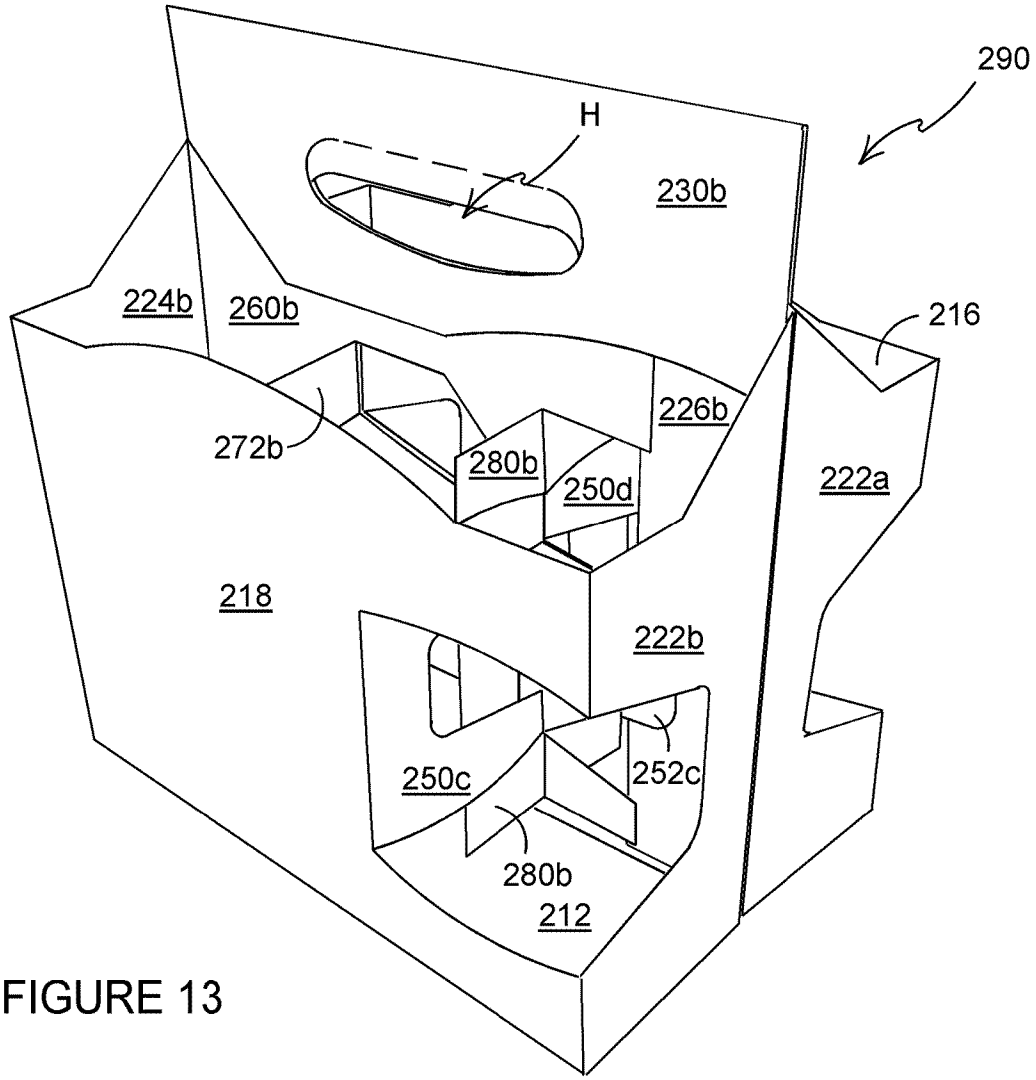
FIG. 13 is a perspective view from above of a carrier formed from the blank of FIG. 11.
Figure 14:
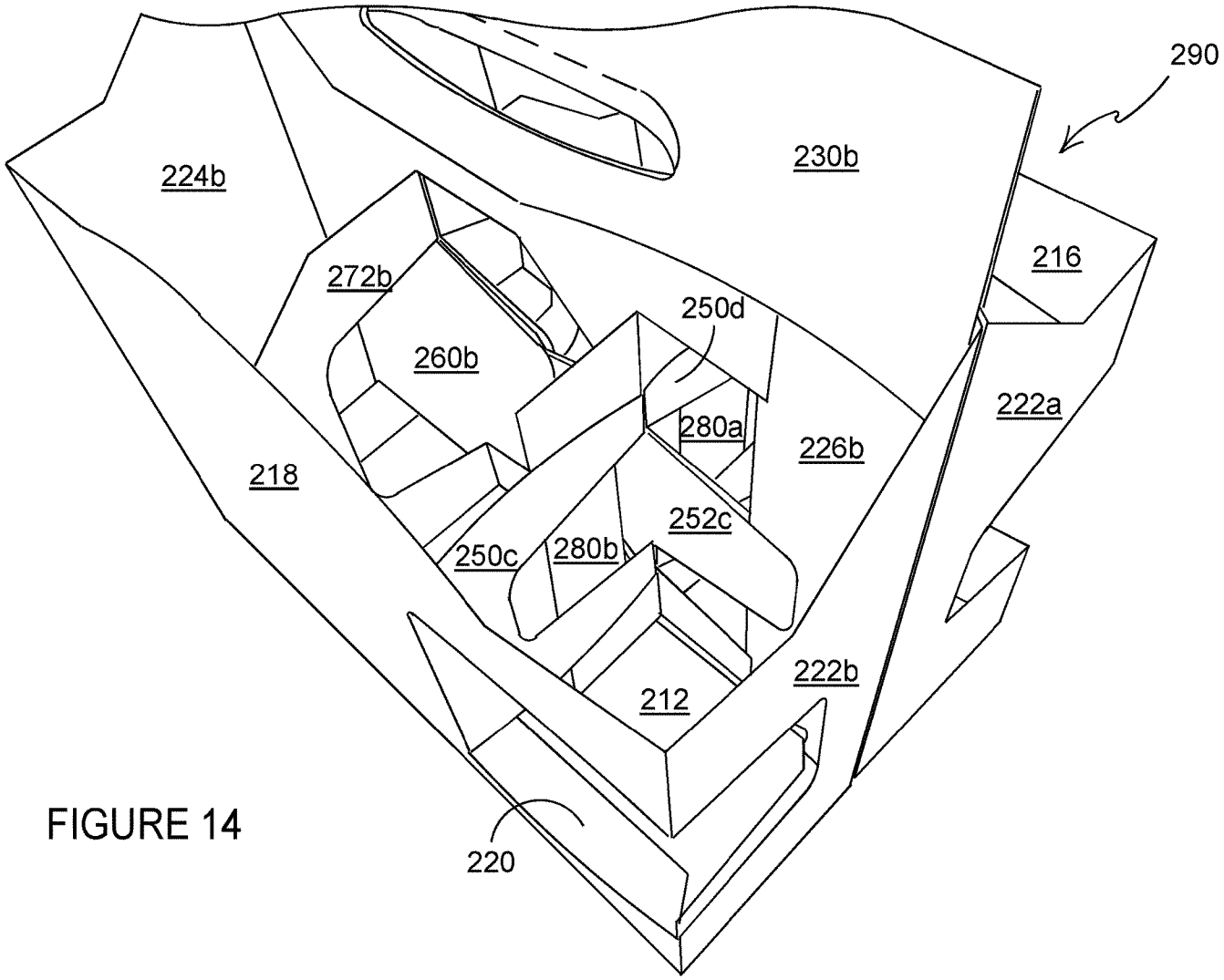
FIG. 14 is a perspective view from above of a portion of the carrier formed from the blank of FIG. 11 showing an internal cellular structure.
Figure 15:
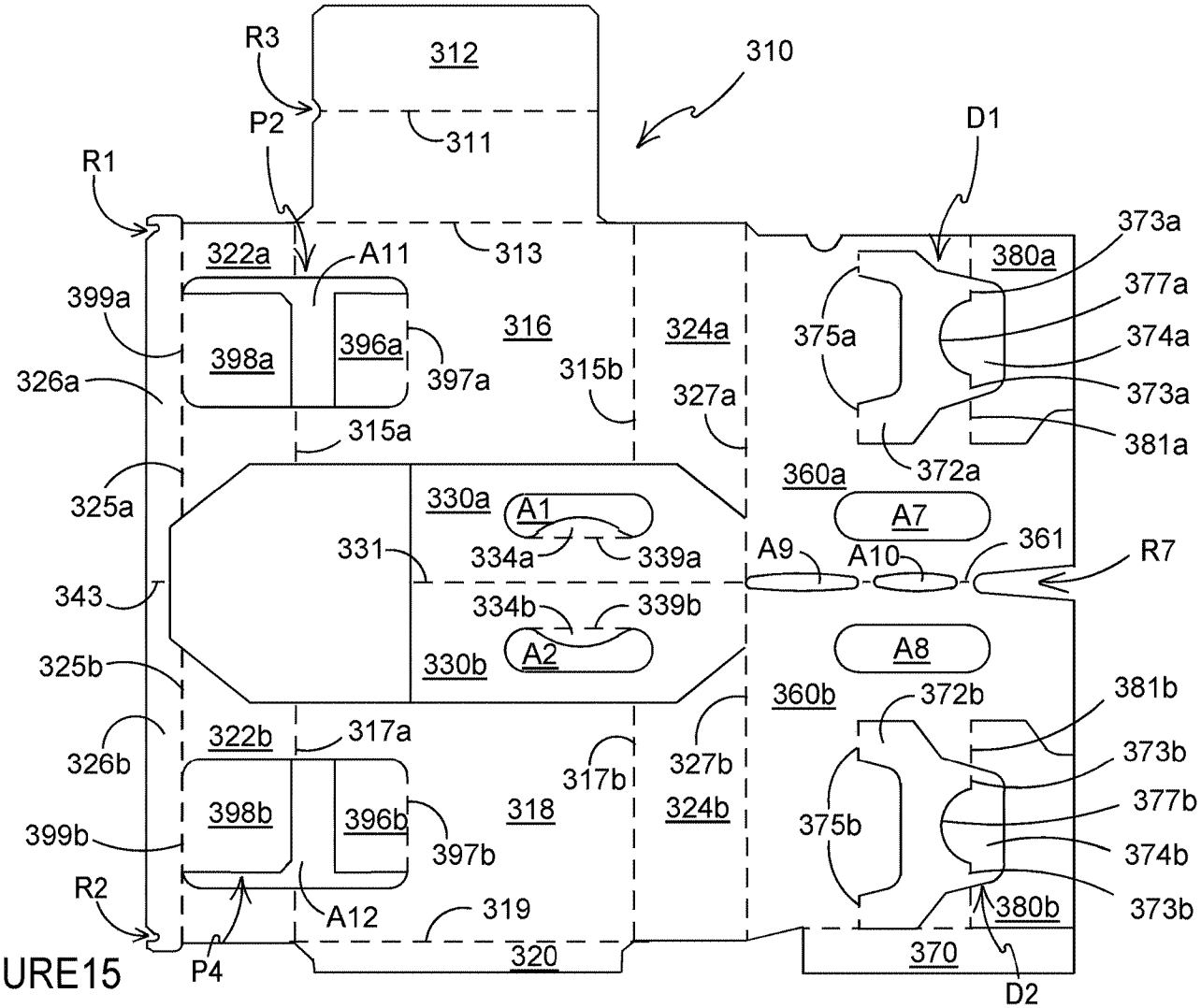
FIG. 15 is a plan view from above of a blank for forming a carrier according to a fourth embodiment.

The flat collapsed carrier may be erected by separating the first side panel 216 from the second side panel 218. In this way a carrier 290 is formed as illustrated in FIG. 13, the carrier 290 has a plurality of cells each for receiving an article (not shown). The illustrated carrier 290 has 6 cells, three cells on each side of the carrying handle H.

In the erected condition the third recess R3 is received in the first and second recesses R1, R2 so as to interlock the base panel 212 with the first and third riser panels 226*a*, 226*b*. In this way the carrier 290 is locked in an erected condition.

The partition structures P1, P2, D1, D2 are automatically erected within the carrier 290 when the flat collapsed carrier is erected. The carrier 290, in its erected form, may be loaded with articles through the open top end of the carrier 290.

The carrier 290 has a pair of transverse cell partitions on each side of the carrying handle H. Two of the cell partitions are formed from the outer walls of the carrier 290. Two of the cell partitions are formed from the centrally disposed first and second divider panels 260*a*, 260*b*.

Each of the cell partitions formed from the first and second divider panels 260*a*, 260*b* have an inverted "T" shaped structure. The upright member of the "T" shape is hinged to a respective one of the first and second divider panels 260*a*, 260*b*. The horizontal member of the "T" shape is secured to a respective one of the first and second side walls 216, 218.

Each of the cell partitions formed the outer walls of the carrier 290 have a "T" shaped structure. The upright member of the "T" shape is hinged to a respective one of the first and second side walls 216, 218. Each of the horizontal members of the "T" shaped cell partitions is secured at a first end to a respective one of the first and third riser panels 226*a*, 226*b*. Each of the horizontal members of the "T" shaped cell partitions is secured at a second opposing end to a respective one of the first and second divider panels 260*a*, 260*b*. Each of the cell partitions is reinforced by a respective one of the third and seventh partition panel reinforcing panels 280*a*, 280*b*.

Referring now to FIGS. 15 to 19, there is shown an additional embodiment of the present disclosure. In the fourth illustrated embodiment, like numerals have, where possible, been used to denote like parts, albeit with the addition of the prefix "300" to indicate that these features belong to the fourth embodiment. The additional embodiment shares many common features with the first, second and third embodiments and therefore only the differences from the embodiments illustrated in FIGS. 1 to 14 will be described in detail.

The blank 310 comprises a plurality of main panels 312, 316, 318, 320, 322*a*, 322*b*, 324*a*, 324*b* for forming walls of the carrier. The blank 310 comprises a base panel 312 hinged to a first side panel 316 by a fold line 313. The first side panel 316 is hinged at a first end to a first end panel 322*a* by a fold line 315*a*. The first side panel 316 is hinged at a second end to a second end panel 324*a* by a fold line 315*b*. The blank 310 comprises a second side panel 318. The second side panel 318 is hinged at a first end to a third end panel 322*b* by a fold line 317*a*. The second side panel 318 is hinged at a second end to a fourth end panel 324*b* by a fold line 317*b*. A securing panel 320 is hinged to the second side panel 318 by a fold line 319.

The blank 310 comprises a first riser panel 326*a* hinged to the first end panel 322*a* by a fold line 325*a*. The blank 310 comprises a third riser panel 326*b* hinged to the third end panel 322*b* by a fold line 325*b*. The first riser panel 326*a* is hinged to the third riser panel 326*b* by a fold line 343.

The blank 310 comprises a first divider panel 360*a* hinged to the second end panel 324*a* by a fold line 327*a*. The blank 310 comprises a second divider panel 360*b* hinged to the fourth end panel 324*b* by a fold line 327*b*. The first divider panel 360*a* is hinged to the second divider panel 360*b* by a fold line 361. Optionally, the fold line 361 is interrupted by apertures A9, A10 and a recess or cutaway R7 each of which is struck in part from the first divider panel 360*a* and in part from the second divider panel 360*b*.

The first divider panel 360*a* includes a fifth handle aperture A7; an upper region—in a set up carrier 390—of the first divider panel 360*a* serves to reinforce the carrying handle H formed by the first and second handle panels 330*a*, 330*b*.

The second divider panel 360*b* includes a sixth handle aperture A8; an upper region—in a set up carrier 390—of the second divider panel 360*b* serves to reinforce the carrying handle H formed by the first and second handle panels 330*a*, 330*b*.

A lower region—in a set up carrier 390—of the first divider panel 360*a* provides a first partition structure D1. The first partition structure D1 is struck from the lower region of the first divider panel 360*a* and provides a transverse cell divider. The first partition structure D1 comprises a first partition panel 372*a* hinged to the first divider panel 360*a* by fold line 375*a*, the fold line 375*a* is interrupted by a substantially "U" shaped cut line or severance line. A first glue panel 374*a* is hinged to the first partition panel 372*a* by a fold line 373*a*, the fold line 373*a* is interrupted by a substantially "U" shaped cut line or severance line 377*a*.

A second partition structure P2 is formed in part from the first side panel 316 and optionally in part from the first end panel 322*a*. The second partition structure P2 comprises a third partition panel 396*a* struck from the first side panel 316 and an optional fourth partition panel 398*a* struck from the first end panel 322*a*. The third partition panel 396*a* is separated from the fourth partition panel 398*a* by an aperture A11, optionally aperture A11 is substantially "T" shaped so as to define a lower edge—in a set up carrier 390—of each of the third and fourth partition panels 396*a*, 398*a*. Aperture A11 is struck in part from the first side panel 316 and in part from the first end panel 322*a*. The third partition panel 396*a* is hinged to the first side panel 316 by a fold line 397*a*. The fourth partition panel 398*a* is hinged to the first end panel 322*a* by a fold line 399*a*. The fold line 399*a* is collinear with the fold line 325*a* between the first riser panel 326*a* and the first end panel 322*a*.

A lower region—in a set up carrier 390—of the second divider panel 360*b* provides a third partition structure D2. The third partition structure D2 is struck from the lower region of the second divider panel 360*b* and provides a transverse cell divider. The third partition structure D2 comprises a fifth partition panel 372*b* hinged to the second divider panel 360*b* by fold line 375*b*, the fold line 375*b* is interrupted by a substantially "U" shaped cut line or severance line. A second glue panel 374*b* is hinged to the fifth partition panel 372*b* by a fold line 373*b*, the fold line 373*b* is interrupted by a substantially "U" shaped cut line or severance line 377*b*.

A fourth partition structure P4 is formed in part from the second side panel 318 and optionally in part from the third end panel 322*b*. The fourth partition structure P4 comprises a seventh partition panel 396*b* struck from the first side panel 316 and an optional eighth partition panel 398*b* struck from the third end panel 322*b*. The seventh partition panel 396*b* is separated from the eighth partition panel 398*b* by an aperture A12, optionally aperture A12 is substantially "T" shaped so as to define a lower edge—in a set up carrier 390—of each of the seventh and eighth partition panels 396*b*, 398*b*. Aperture A12 is struck in part from the second side panel 318 and in part from the third end panel 322*b*. The seventh partition panel 396*b* is hinged to the second side panel 318 by a fold line 397*b*. The eighth partition panel 398*b* is hinged to the third end panel 322*b* by a fold line 399*b*. The fold line 399*b* is collinear with the fold line 325*a* between the third riser panel 326*b* and the third end panel 322*b*.

The first divider panel 360*a* and the second divider panel 360*b* serve to provide a longitudinal partition; the first divider panel 360*a* and the second divider panel 360*b* extend across the longitudinal dimension of the carrier 390.

The first divider panel 360*a* comprises a third partition panel anchor panel 380*a*. The third partition panel anchor panel 380*a* is struck from the first divider panel 360*a* and is hinged thereto by a fold line 381*a*. Optionally, the first glue panel 374*a* is struck from the third partition panel reinforcing panel 380*a*, and fold line 381*a* may be collinear with fold line 373*a*.

The second divider panel 360*b* comprises a seventh partition panel anchor panel 380*b*. The seventh partition panel anchor panel 380*b* is struck from the second divider panel 360*b* and is hinged thereto by a fold line 381*b*. Optionally, the second glue panel 374*b* is struck from the seventh partition panel reinforcing panel 380*b*, and fold line 381*b* may be collinear with fold line 373*b*.

A support panel 370 is hinged to the lower edge of the second divider panel 360*b*. The support panel 370 supports the lower end of the seventh partition panel reinforcing panel 380*b*; this is required because the fifth partition panel 372*b* extends to the lower edge of the second divider panel 360*b* so as to separate the lower end of the seventh partition panel reinforcing panel 380*b* from the second divider panel 360*b*. In alternative embodiments, the support panel 370 may be omitted if a portion of the second divider panel 360*b* is provided below the fifth partition panel 372*b*, in a similar manner to that shown in respect of the first divider panel 360*a* and first partition panel 372*a*. In yet other embodiments a support panel may be hinged to a lower edge—in a set up condition—if the first partition panel 372*a* is arranged in a similar manner to the fifth partition panel 372*b*, that is to say the first partition panel 372*a* extends to the lower edge of the first divider panel 360*a*.

The first riser panel 326*a* comprises a first recess R1 which is configured to form a hook like projection on a side edge thereof. The third riser panel 326*b* comprises a second recess R2 which is configured to form a hook like projection on a side edge thereof.

Turning to the construction of the carrier 390 as illustrated in FIGS. 16*a* to 16*h*, the carrier 390 can be formed by a series of sequential folding operations in a straight line machine so that the carrier 390 is not required to be rotated or inverted to complete its construction. The folding process is not limited to that described below and may be altered according to particular manufacturing requirements.

Figure 16B:
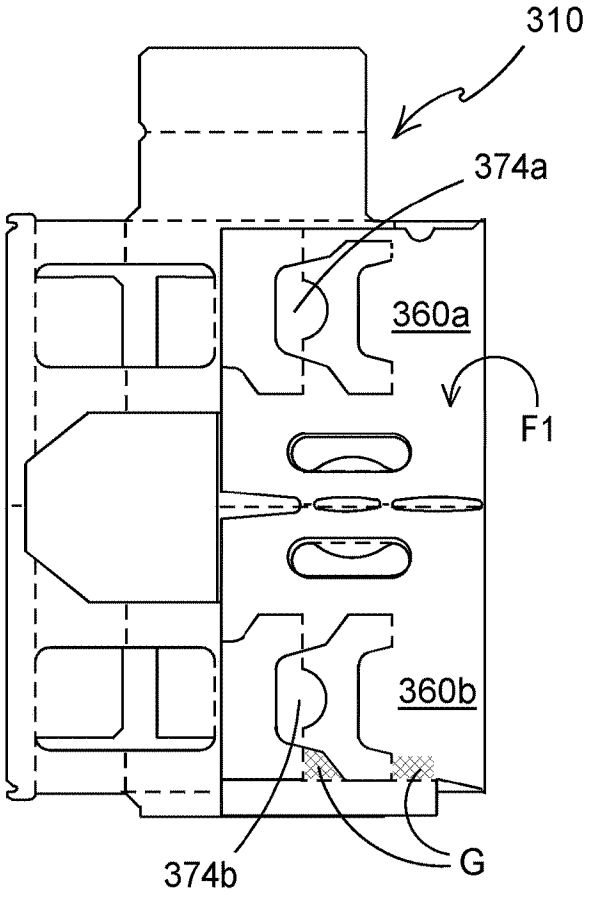
FIGS. 16*a* to 16*h* are plan views from above of stages of construction of the blank of FIG. 15.
Figure 16A:
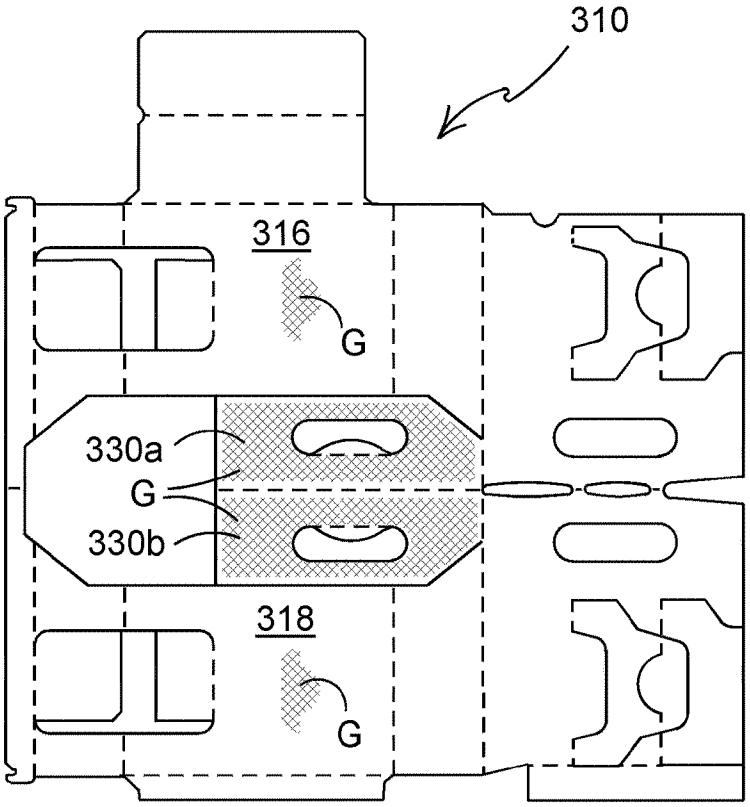

Glue G or other adhesive treatment is applied to a region of the first side panel 316, to a region of the second side panel 318 and to the first and second handle panels 330*a*, 330*b*, as shown in FIG. 16*a*. The region of the first side panel 316 to which glue is applied corresponds to a portion which will be brought into contact with the first glue panel 374*a* when the blank 310 is folded about fold lines 327*a*, 327*b*. The region of the second side panel 318 to which glue is applied corresponds to a portion which will be brought into contact with the second glue panel 374*b* when the blank 310 is folded about fold lines 327*a*, 327*b*. The end regions of the first and second handle panels 330*a*, 330*b* to which glue is applied correspond to portions which will be brought into contact with the respective one of the first and second divider panels 360*a*, 360*b* when the blank 310 is folded about fold lines 327*a*, 327*b*.

The blank 310 is folded, as shown in FIG. 16*b* by direction arrow F1, about fold lines 327*a* and 327*b* such that the first and second divider panels 360*a*, 360*b* are brought into face contacting relationship with each of the second end panel 324*a*, the fourth end panel 324*b*, the first and second handle panels 330*a*, 330*b* and the first and second side panels 316, 318.

The first divider panel 360*a* is secured to the first handle panel 330*a*. The first side panel 316 is secured to the first glue panel 374*a*. The second divider panel 360*b* is secured to the second handle panel 330*b*. The second side panel 318 is secured to the second glue panel 374*b*.

Glue G or other adhesive treatment is applied to lower regions of the second divider panel 360*b*. The lower regions of the second divider panel 360*b* to which glue or other adhesive treatment is applied corresponds to those portions of the second divider panel 360*b* which will be in face contacting relationship with the support panel 370 when the blank 310 is folded about the fold line 371.

Figure 16D:
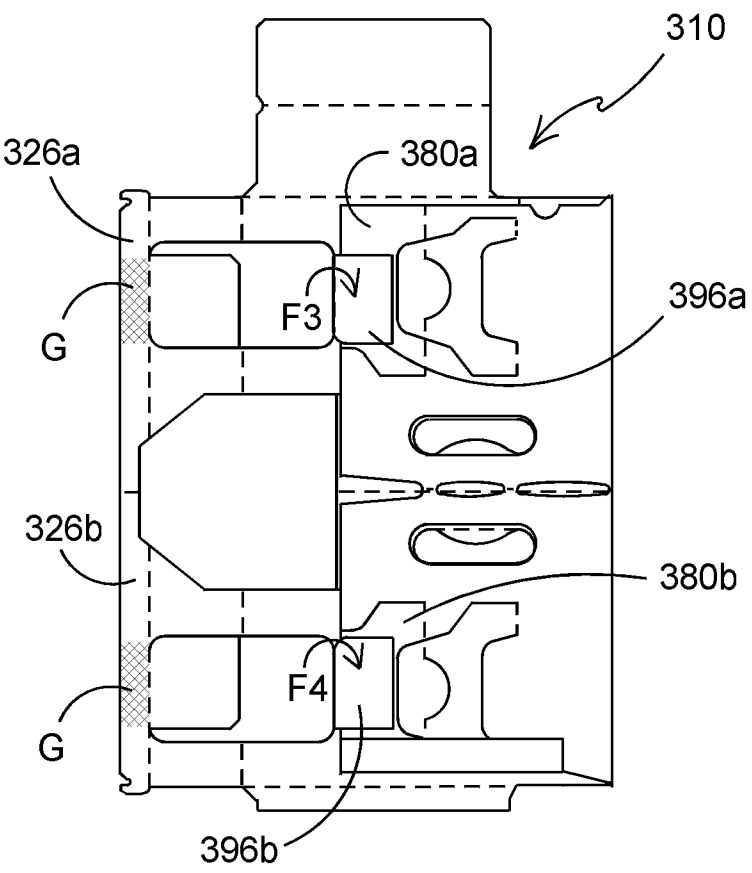
Figure 16C:
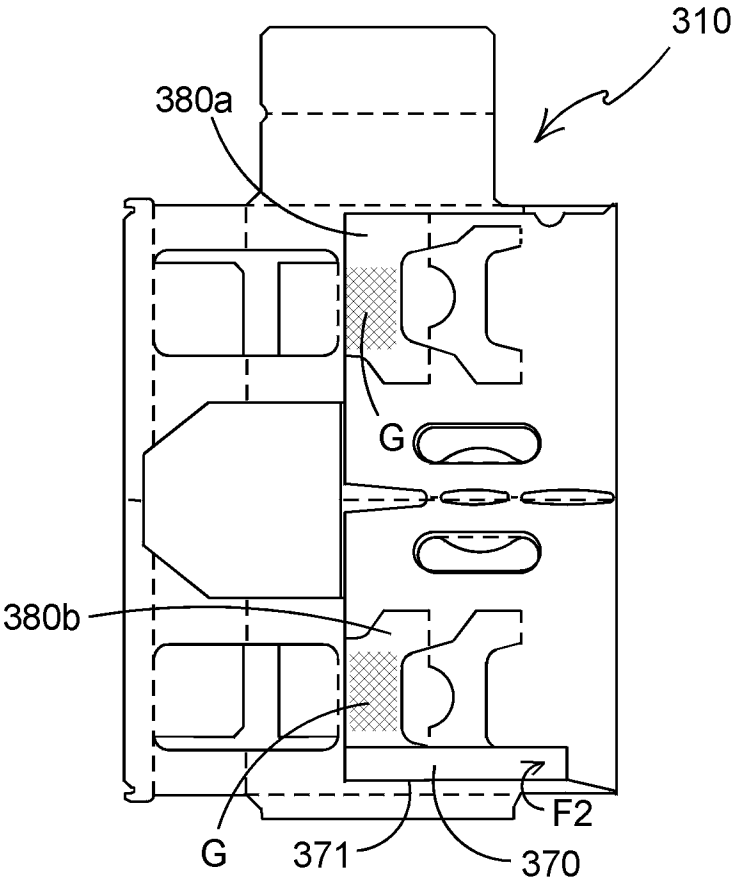

The blank 310 is folded, as indicated by direction arrow F2 in FIG. 16*c*, about fold line 371 such that the support panel 370 is brought into face contacting relationship with the second divider panel 360*b*. The support panel 370 is secured to the second divider panel 360*b*.

Glue G or other adhesive treatment is applied to third partition panel anchor panel 380*a* and the seventh partition panel anchor panel 380*b*.

The blank 310 is folded, as indicated by direction arrow F3 in FIG. 16*d*; about fold line 397*a* such that the third partition panel 396*a* is brought into face contacting relationship with the third partition panel anchor panel 380*a*. The third partition panel 396*a* is secured to the third partition panel anchor panel 380*a*.

The blank 310 is folded, as indicated by direction arrow F4 in FIG. 16*c*, about fold line 397*b* such that the seventh partition panel 396*b* is brought into face contacting relationship with the seventh partition panel anchor panel 380*b*. The seventh partition panel 396*b* is secured to the seventh partition panel anchor panel 380*b*.

Glue G or other adhesive treatment is applied to the first riser panel 326*a* adjacent to the fourth partition panel 398*a* and to the third riser panel 326*b* adjacent to the eighth partition panel 398*b*.

Figure 16G:
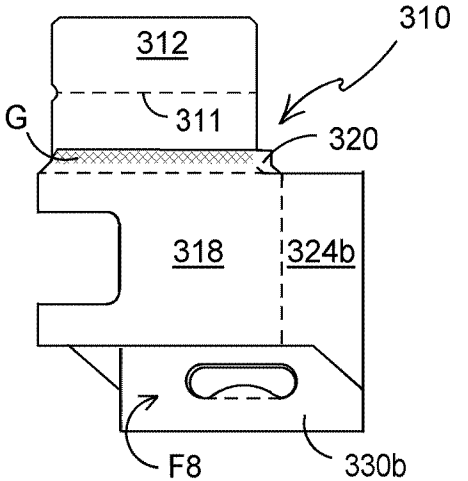
Figure 16H:
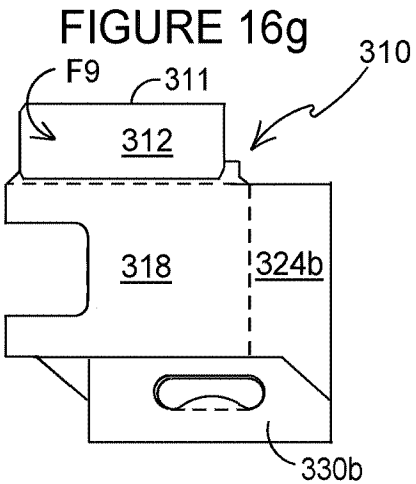
Figure 16F:
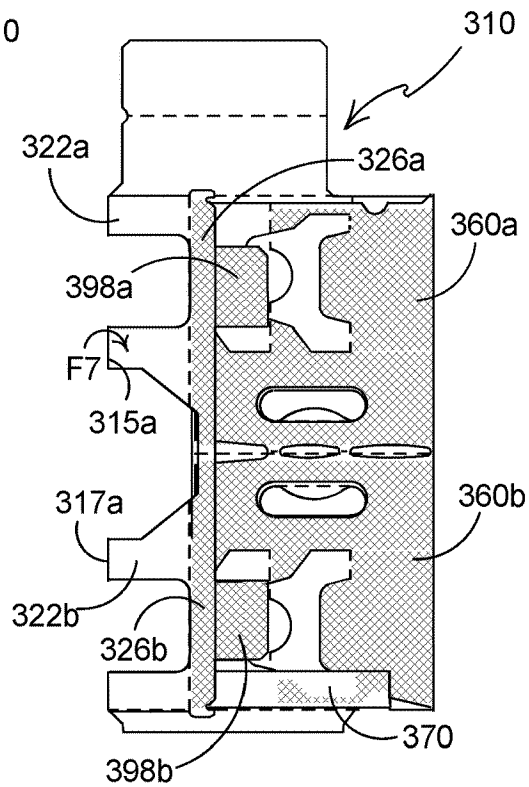
Figure 16E:
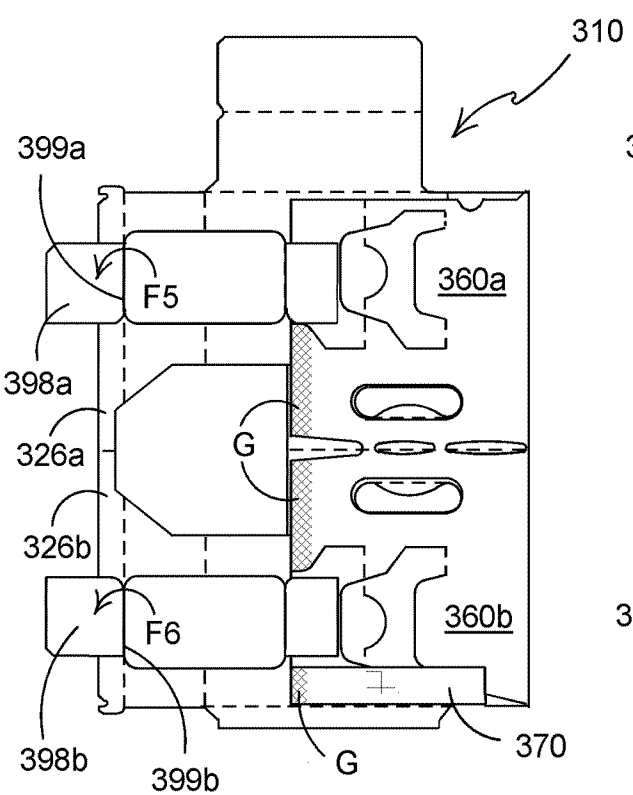

The blank 310 is folded, as indicated by direction arrow F5 in FIG. 16*e*, about fold line 399*a*; the fourth partition panel 398*a* is brought into face contacting relationship with the first riser panel 326*a*. The fourth partition panel 398*a* is secured to the first riser panel 326*a*.

The blank 310 is folded, as indicated by direction arrow F6 in FIG. 16*e*, about fold line 399*b*; the eighth partition panel 398*b* is brought into face contacting relationship with the third riser panel 326*b*. The eighth partition panel 398*b* is secured to the third riser panel 326*b*.

Glue G or other adhesive treatment is applied to an end region of each of the first divider panel 360*a* and the second divider panel 360*b*. The end regions of the first and second divider panels 360*a*, 360*b* to which glue or other adhesive treatment is applied corresponds to those portions of the first and second divider panels 360*a*, 360*b* which will be in face contacting relationship with the respective one of the first and third riser panels 326*a*, 326*b* when the blank 310 is folded about the fold lines 322*a*, 322*b*.

The blank 310 is folded, as indicated by direction arrow F7 in FIG. 16*f*, about fold lines 322*a*, 322*b*. The first end panel 322*a* is brought into overlying relationship with the first side panel 316. The third end panel 322*b* is brought into overlying relationship with the second side panel 318. The first riser panel 326*a* is brought into face contacting relationship with the first divider panel 260*a* and the fourth partition panel 398*a*. The first riser panel 326*a* is secured to the first divider panel 360*a*. The third riser panel 326*b* is brought into face contacting relationship with the second divider panel 360*b* and the eighth partition panel 398*b*. The third riser panel 226*b* is secured to the second divider panel 360*b*.

Glue G or other adhesive treatment is applied to; the first riser panel 326*a*, third riser panel 326*b*, the fourth partition panel 398*a*, the eighth partition panel 398*b*, the first divider panel 360*a* and the second divider panel 360*b*, as shown in FIG. 16*f*.

The blank 310 is folded, as indicated by direction arrow F8 in FIG. 16*g*, about fold lines 331, (and about fold lines 343, 361 which are disposed in overlying relationship with fold line 331) such that the second side panel 318 is disposed in overlying relationship with the first side panel 316. The second handle panel 330*b* is disposed in overlying relationship with the first handle panel 330*a*. The fourth end panel 324*b* is disposed in overlying relationship with the second end panel 324*a*.

Glue G or other adhesive treatment is applied to the securing panel 320.

The blank 310 is folded, as indicated by direction arrow F9 in FIG. 16*h*, about fold line 311 so as to fold the base panel 312 upon itself, a portion of the base panel 312 is brought into face contacting relationship with the securing panel 320 and secured thereto.

A flat collapsed carrier is formed as shown in FIG. 16*h*. The flat collapsed carrier may be shipped or distributed in this flat collapsed form.

Figure 17:
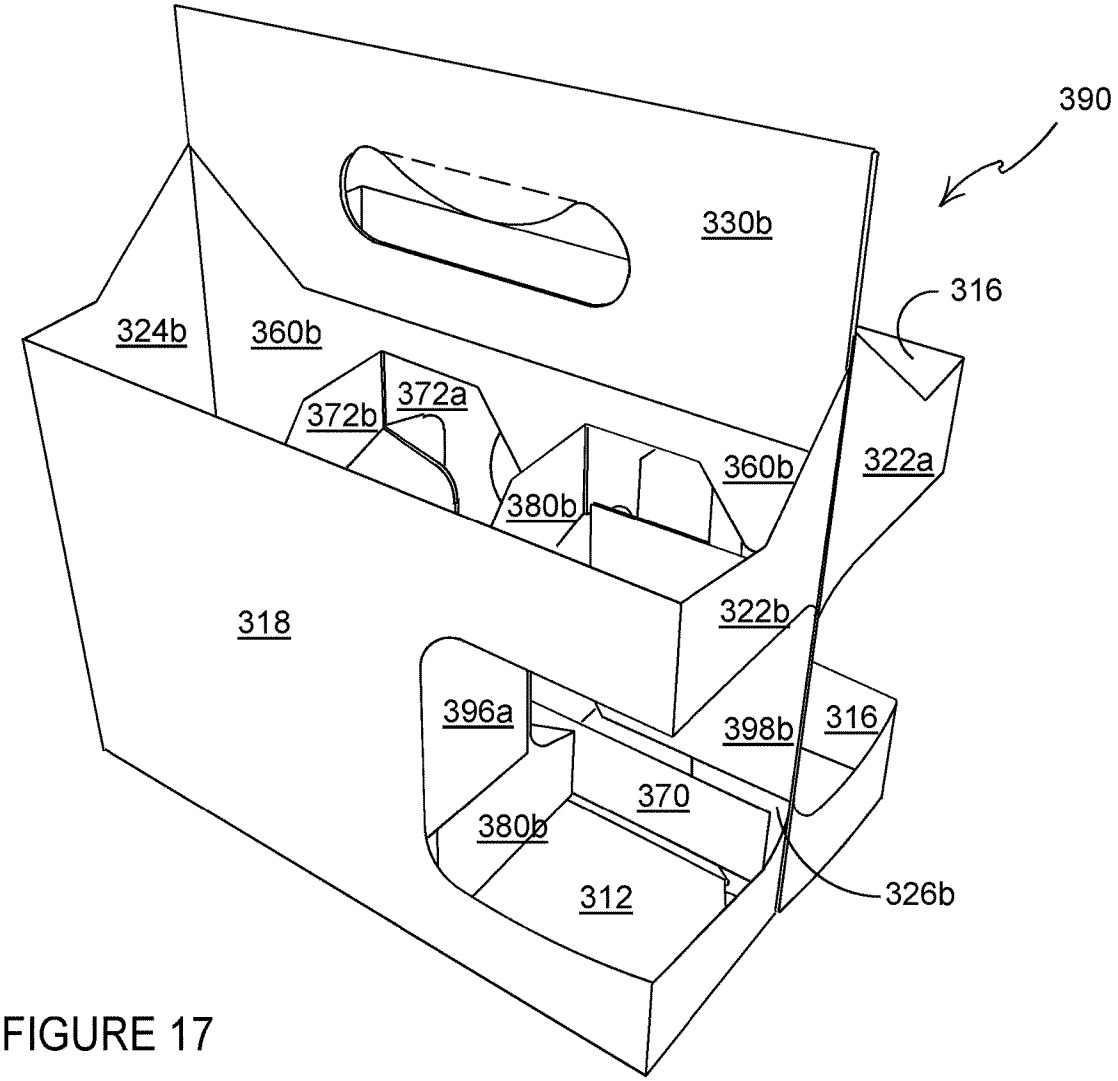
FIG. 17 is a perspective view from above of a carrier formed from the blank of FIG. 15.

The flat collapsed carrier may be erected by separating the first side panel 316 from the second side panel 318. In this way a carrier 390 is formed as illustrated in FIG. 17, the carrier 390 has a plurality of cells each for receiving an article (not shown). The illustrated carrier 390 has 6 cells, three cells on each side of the carrying handle H.

In the erected condition the third recess R3 is received in the first and second recesses R1, R2 so as to interlock the base panel 312 with the first and third riser panels 326*a*, 326*b*. In this way the carrier 390 is locked in an erected condition.

The partition structures P1, P2, D1, D2 are automatically erected within the carrier 390 when the flat collapsed carrier is erected. The carrier 390, in its erected form, may be loaded with articles through open top end of the carrier 390.

The carrier 390 has a pair of transverse cell partitions on each side of the carrying handle H. Two of the cell partitions are formed in part from the outer walls of the carrier 390 and in part the centrally disposed first and second divider panels 360*a*, 360*b*. Two of the cell partitions are formed entirely from the centrally disposed first and second divider panels 360*a*, 360*b*.

Each of the cell partitions formed entirely from the first and second divider panels 360*a*, 360*b* have an inverted "T" shaped structure. The upright member of the "T" shape is hinged to a respective one of the first and second divider panels 360*a*, 360*b*. The horizontal member of the "T" shape is secured to a respective one of the first and second side walls 316, 318.

Figure 18:
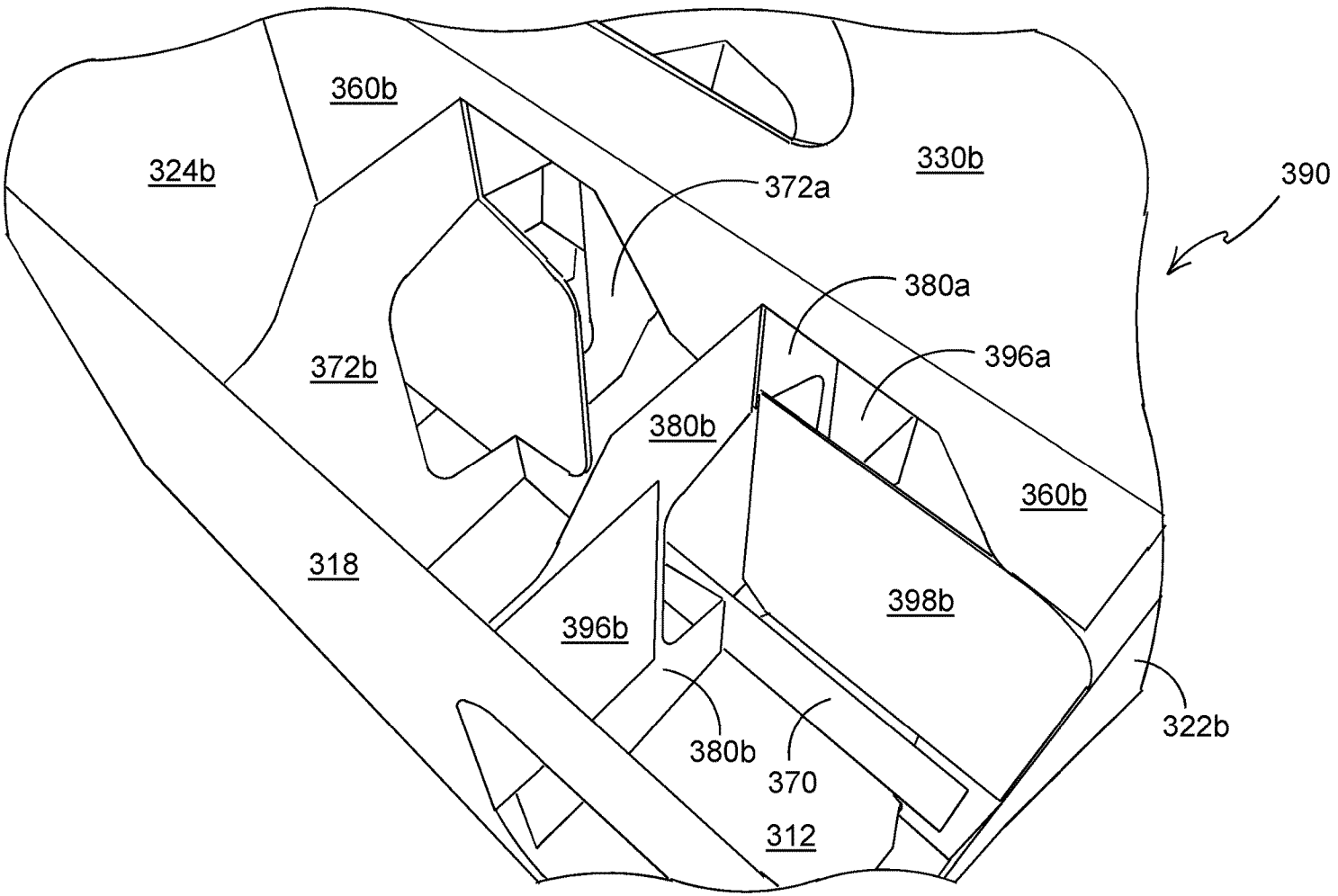
FIG. 18 is a perspective view from above of a portion of the carrier formed from the blank of FIG. 15 showing an internal cellular structure.
Figure 19:
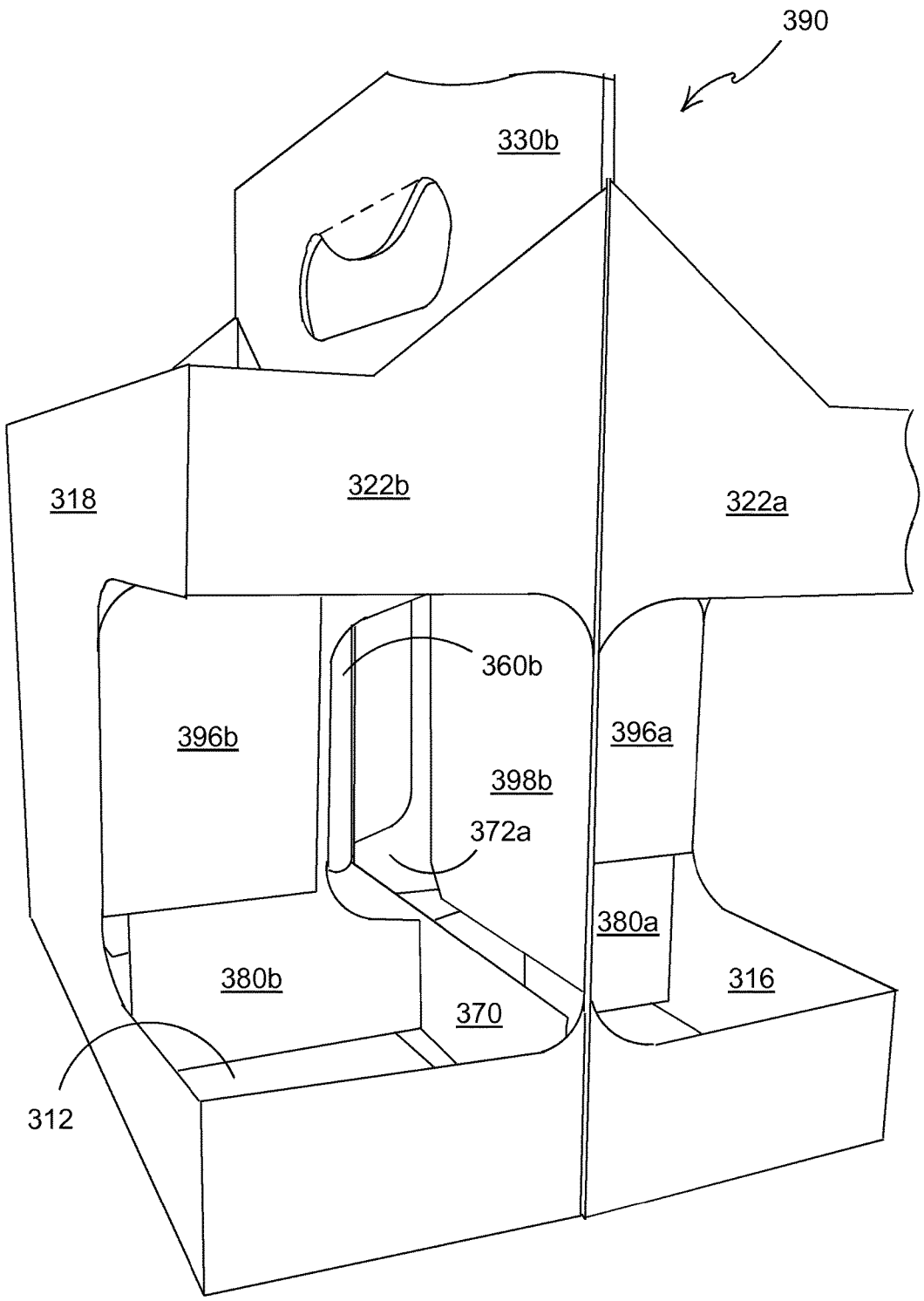
FIG. 19 is an alternative perspective view from one end of the carrier of FIG. 17.
Figure 20:
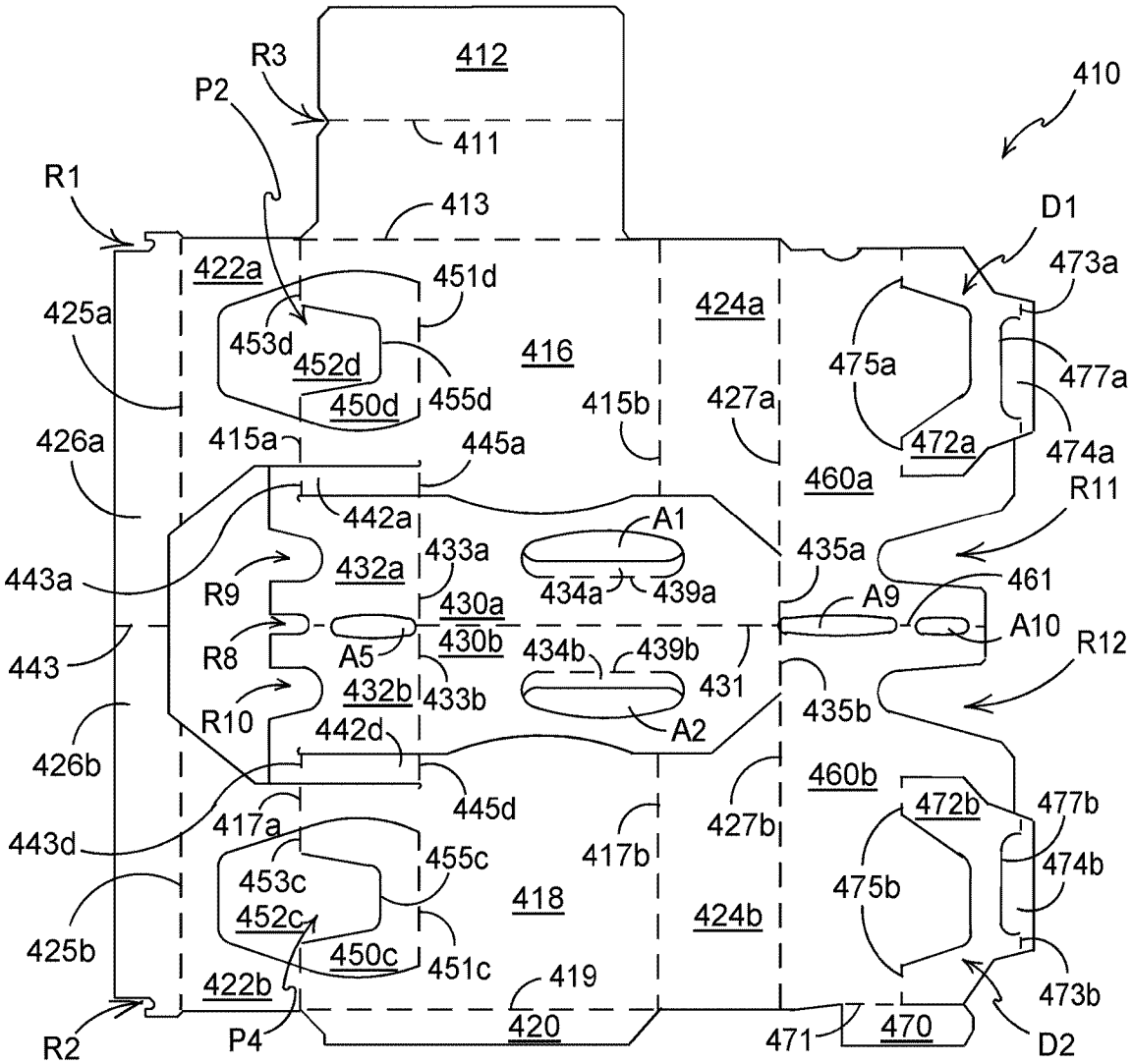
FIG. 20 is a plan view from above of a blank for forming a carrier according to a fifth embodiment.

Each of the cell partitions formed in part from the outer walls of the carrier 390 have an "I" shaped structure see FIG. 18. The "I" shape is formed from a first part hinged to a respective one of the first and second side walls 316, 318. The "I" shape is formed from a second part hinged to a respective one of the first and second divider panels 360*a*, 360*b*. Each first part is secured to an adjacent second part so as to extend transversely between an outer side wall 316, 318 and centrally disposed first and second divider panels 360*a*, 360*b*.

The optional fourth and eighth partition panels 398*a*, 398*b* are configured to act as a longitudinally extending partition. The fourth and eighth partition panels 398*a*, 398*b* extend longitudinally into the carrier 390 from the end wall defined by the first and third end wall panels 322*a*, 322*b*. The fourth and eighth partition panels 398*a*, 398*b* extend into the carrier 390 beyond the first and third riser panels 326*a*, 326*b*.

The support panel 370 is secured to the third riser panel 326*b* and indirectly to the first riser panel 326*a*, in this way the support panel 370 provides a longitudinally extending partition below fourth and eighth partition panels 398*a*, 398*b*. The support panel 370 acts as a brace between the first and third riser panels 326*a*, 326*b* and the first and second divider panels 360*a*, 360*b*.

Referring now to FIGS. 20 to 23, there is shown an additional embodiment of the present disclosure. In the fifth illustrated embodiment, like numerals have, where possible, been used to denote like parts, albeit with the addition of the prefix "400" to indicate that these features belong to the fifth embodiment. The additional embodiment shares many common features with the first, second, third and fourth embodiments and therefore only the differences from the embodiments illustrated in FIGS. 1 to 19 will be described in detail.

The blank 410 comprises a plurality of main panels 412, 416, 418, 420, 422*a*, 422*b*, 424*a*, 424*b* for forming walls of the carrier. The blank 410 comprises a base panel 412 hinged to a first side panel 416 by a fold line 413. The first side panel 416 is hinged at a first end to a first end panel 422*a* by a fold line 415*a*. The first side panel 416 is hinged at a second end to a second end panel 424*a* by a fold line 415*b*. The blank 410 comprises a second side panel 418. The second side panel 418 is hinged at a first end to a third end panel 422*b* by a fold line 417*a*. The second side panel 418 is hinged at a second end to a fourth end panel 424*b* by a fold line 417*b*. A securing panel 420 is hinged to the second side panel 418 by a fold line 419.

The blank 410 comprises a first handle panel 430*a* and a second handle panel 430*b* disposed in part between the first side panel 416 and the second side panel 418. The first handle panel 430*a* and the second handle panel 430*b* are disposed in part between the second end panel 424*a* and the fourth end panel 424*b*.

The blank 410 comprises a first handle reinforcing panel 432*a* and a second handle reinforcing panel 432*b* disposed in part between the first side panel 416 and the second side panel 418. The first handle reinforcing panel 432*a* and the second handle reinforcing panel 432*b* are disposed in part between the first end panel 422*a* and the third end panel 422*b*. The first handle reinforcing panel 432*a* and the second handle reinforcing panel 432*b* reinforce the carrying handle H by overlapping with portions of the first handle panel 430*a* and a second handle panel 430*b*.

The first handle panel 430*a* comprises a first handle aperture A1 struck therefrom. The first handle aperture A1 is defined in part by an optional cushioning flap 434*a* which is hinged to the first handle panel 430*a* by a fold line 439*a*.

The second handle panel 430*b* comprises a second handle aperture A2 struck therefrom. The second handle aperture A2 is defined in part by an optional cushioning flap 434*b* which is hinged to the second handle panel 430*b* by a fold line 439*b*.

The first handle reinforcing panel 432*a* comprises a first handle cutaway R9 struck therefrom. The second handle reinforcing panel 432*b* comprises a second handle cutaway R10 struck therefrom.

The blank 410 comprises a first riser panel 426*a* hinged to the first end panel 422*a* by a fold line 425*a*. The blank 410 comprises a third riser panel 426*b* hinged to the third end panel 422*b* by a fold line 425*b*. The first riser panel 426*a* is hinged to the third riser panel 426*b* by a fold line 443.

The blank 410 comprises a first connecting panel 442*a* hinged at a first end to the first side panel 416 by a fold line 445*a* and at a second end to the first handle reinforcing panel 432*a* by a fold line 443*a*. The first connecting panel 442*a* is disposed between first side panel 416 and the first handle reinforcing panel 432*a*.

The blank 410 comprises a fourth connecting panel 442*d* hinged at a first end to the second side panel 418 by a fold line 445*d* and at a second end to the second handle reinforcing panel 432*b* by a fold line 443*d*. The fourth connecting panel 442*d* is disposed between second side panel 418 and the second handle reinforcing panel 432*b*.

The blank 410 comprises a first divider panel 460*a* hinged to the second end panel 424*a* by a fold line 427*a*. The blank 410 comprises a second divider panel 460*b* hinged to the fourth end panel 424*b* by a fold line 427*b*. The first divider panel 460*a* is hinged to the second divider panel 460*b* by a fold line 461. Optionally, the fold line 461 is interrupted by apertures A9, A10 each of which is struck in part from the first divider panel 460*a* and in part from the second divider panel 460*b*.

The first divider panel 460*a* includes a third handle cutaway R11; an upper region—of a set up carrier 490—of the first divider panel 460*a* serves to reinforce in part the carrying handle H formed by the first and second handle panels 430*a*, 430*b*.

The second divider panel 460*b* includes a fourth handle cutaway R12; an upper region—in a set up carrier 490—of the second divider panel 460*b* serves to reinforce the carrying handle H formed by the first and second handle panels 430*a*, 430*b*.

In a constructed carrier 490, the first handle aperture A1, the second handle aperture A2, the first handle cutaway R9, second handle cutaway R10, third handle cutaway R11 and the fourth handle cutaway R12 together form a handle opening of the carrying handle H.

A lower region—in a set up carrier 490—of the first divider panel 460*a* provides a first partition structure D1. The first partition structure D1 is struck from the lower region of the first divider panel 460*a* and provides a transverse cell divider. The first partition structure D1 comprises a first partition panel 472*a* hinged to the first divider panel 460*a* by fold line 475*a*, the fold line 475*a* is interrupted by a substantially "U" shaped cut line or severance line. A first glue panel 474*a* is hinged to the first partition panel 472*a* by a fold line 473*a* the fold line 473*a* is interrupted by a substantially "U" shaped cut line or severance line 477*a*.

A second partition structure P2 is formed in part from the first side panel 416 and in part from the first end panel 422*a*. The second partition structure P2 comprises a third partition panel 450*d* struck from the first side panel 416 and a fourth partition panel 452*d* struck from the first end panel 422*a*. Optionally, the fourth partition panel 452*d* is struck in part from the first side panel 416 and/or the third partition panel 450*d*. The third partition panel 450*d* is hinged to the fourth partition panel 452*d* by a fold line 453*d*. The fold line 453*d* is interrupted by a cutline or severance line 455*d*. Cutline 455*d* is substantially "C" shaped or "U" shaped. The third partition panel 450*d* is hinged to the first side panel 416 by a fold line 451*d*.

A lower region—in a set up carrier 490—of the second divider panel 460*b* provides a third partition structure D2. The third partition structure D2 is struck from the lower region of the second divider panel 460*b* and provides a transverse cell divider. The third partition structure D2 comprises a fifth partition panel 472*b* hinged to the second divider panel 460*b* by fold line 475*b*, the fold line 475*b* is interrupted by a substantially "U" shaped cut line or severance line. A second glue panel 474*b* is hinged to the fifth partition panel 472*b* by a fold line 473*b*, the fold line 473*b* is interrupted by a substantially "U" shaped cut line or severance line 477*b*.

A fourth partition structure P4 is formed in part from the second side panel 418 and in part from the third end panel 422*b*. The fourth partition structure P4 comprises a seventh partition panel 450*c* struck from the second side panel 418 and an eighth partition panel 452*c* struck from the third end panel 422*b*. Optionally, the eighth partition panel 452*c* is struck in part from the second side panel 418 and/or the seventh partition panel 450*c* and struck in part. The seventh partition panel 450*c* is hinged to the eighth partition panel 452*c* by a fold line 453*c*. The fold line 453*c* is interrupted by a cutline or severance line 455*c*. Cutline 455*c* is substantially "C" shaped or "U" shaped. The seventh partition panel 450*c* is hinged to the second side panel 418 by a fold line 451*c*.

The first divider panel 460*a* and the second divider panel 460*b* serve to provide a longitudinal partition, the longitudinal partition extends partially across the longitudinal dimension of the carrier 490.

A support panel 470 is hinged to the lower edge of the second divider panel 460*b* by a fold line 471.

The first riser panel 426*a* comprises a first recess R1 which is configured to form a hook like projection on a side edge thereof. The third riser panel 426*b* comprises a second recess R2 which is configured to form a hook like projection on a side edge thereof.

Turning to the construction of the carrier 490 as illustrated in FIGS. 21*a* to 21*g*, the carrier 490 can be formed by a series of sequential folding operations in a straight line machine so that the carrier 490 is not required to be rotated or inverted to complete its construction. The folding process is not limited to that described below and may be altered according to particular manufacturing requirements.

Figure 21C:
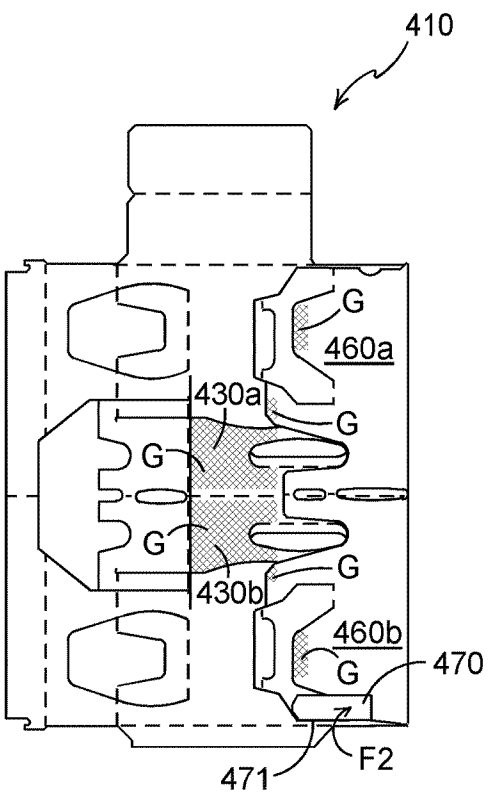
FIGS. 21*a* to 21*g* are plan views from above of stages of construction of the blank of FIG. 20.
Figure 21B:
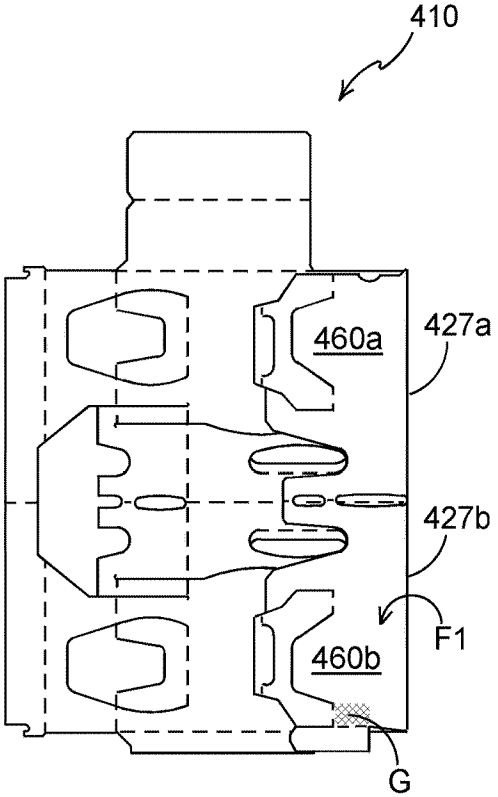
Figure 21A:
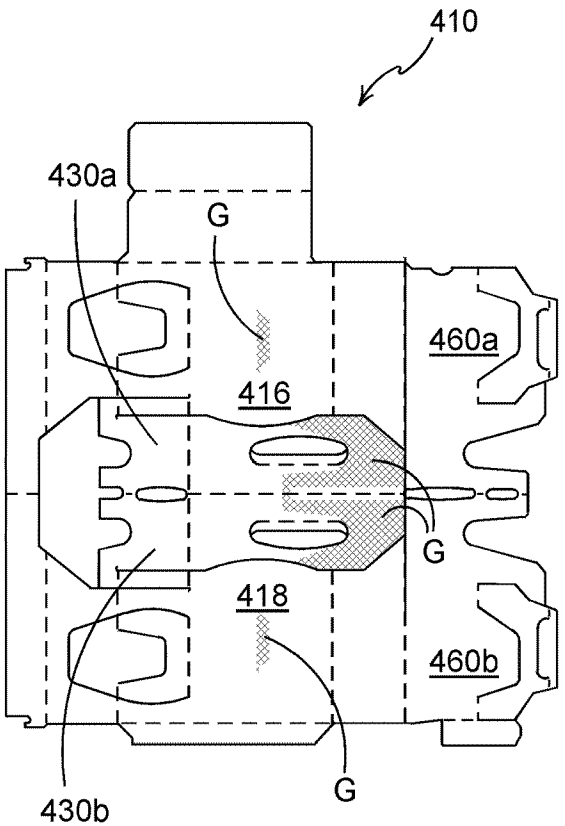

Glue G or other adhesive treatment is applied to a region of the first side panel 416, to a region of the second side panel 418 and to end regions of the first and second handle panels 430*a*, 430*b*, as shown in FIG. 21*a*. The region of the first side panel 416 to which glue is applied corresponds to a portion which will be brought into contact with the first glue panel 474*a* when the blank 410 is folded about fold lines 427*a*, 427*b*. The region of the second side panel 418 to which glue is applied corresponds to a portion which will be brought into contact with the second glue panel 474*b* when the blank 410 is folded about fold lines 427*a*, 427*b*. The end regions of the first and second handle panels 430*a*, 430*b* to which glue is applied correspond to portions which will be brought into contact with the respective one of the first and second divider panels 460*a*, 460*b* when the blank 410 is folded about fold lines 427*a*, 427*b*.

The blank 410 is folded, as shown in FIG. 21*b* by direction arrow F1, about fold lines 427*a* and 427*b* such that the first and second divider panels 460*a*, 460*b* are brought into face contacting relationship with each of the second end panel 424*a*, the fourth end panel 424*b* , the first and second handle panels 430*a*, 430*b* and the first and second side panels 416, 418.

The first divider panel 460*a* is secured to the first handle panel 430*a*. The first side panel 416 is secured to the first glue panel 474*a*. The second divider panel 460*b* is secured to the second handle panel 430*b*. The second side panel 418 is secured to the second glue panel 474*b*.

Glue G or other adhesive treatment is applied to lower regions of the second divider panel 460*b*. The lower regions of the second divider panel 460*b* to which glue or other adhesive treatment is applied corresponds to those portions of the second divider panel 460*b* which will be in face contacting relationship with the support panel 470 when the blank 410 is folded about the fold line 471.

The blank 410 is folded, as indicated by direction arrow F2 in FIG. 21*c*, about fold line 471 such that the support panel 470 is brought into face contacting relationship with the second divider panel 460*b*. The support panel 470 is secured to the second divider panel 460*b*.

Glue G or other adhesive treatment is applied to a portion of the first divider panel 460*a*, adjacent cut line 477*a* and to a portion of the second divider panel 460*b*, adjacent cut line 477*b*, as shown in FIG. 21*c*.

Glue G or other adhesive treatment is applied to end regions of the first and second handle panels 430*a*, 430*b*, as shown in FIG. 21*c*. The end regions of the first and second handle panels 430*a*, 430*b* to which glue is applied correspond to portions which will be brought into contact with the respective one of the first and second handle reinforcing panels 432*a*, 432*b* when the blank 410 is folded about fold lines 433*a*, 433*b*.

Glue G or other adhesive treatment is applied to a portion of the first divider panel 460*a* and to a portion of the second divider panel 460*b*. The portions of the first divider panel 460*a* and the second divider panel 460*b* to which glue is applied correspond to portions which will be brought into contact with the respective one of the first and second handle reinforcing panels 432*a*, 432*b* when the blank 410 is folded about fold lines 433*a*, 433*b*.

Figures 21D, 21E, 21F, 21G:
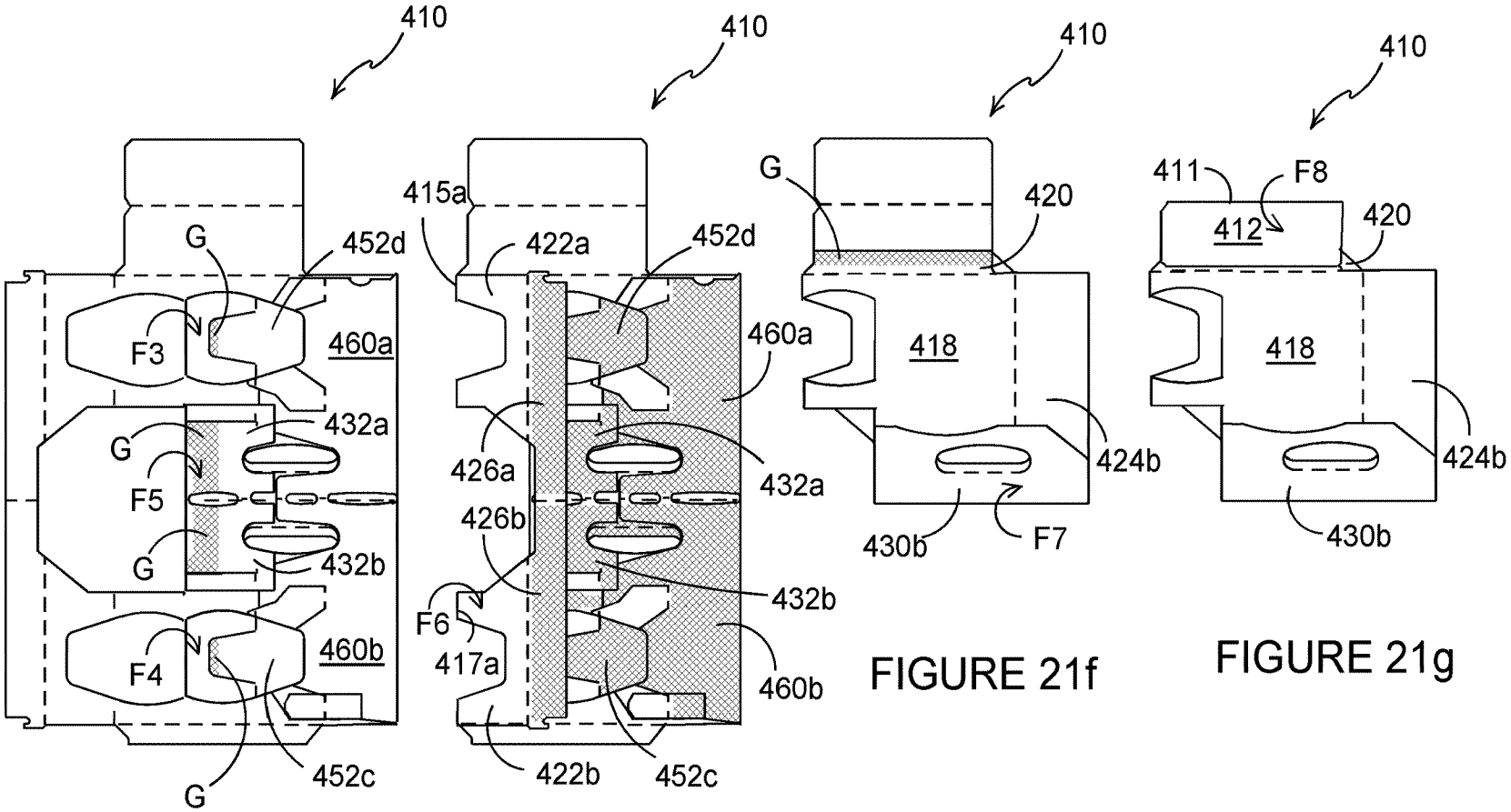

The blank 410 is folded, as indicated by direction arrow F3 in FIG. 21*d*; about fold line 451*d* such that the fourth partition panel 452*d* is brought into face contacting relationship with the first divider panel 460*a*. The fourth partition panel 452*d* is secured to the first divider panel 460*a*.

The blank 410 is folded, as indicated by direction arrow F4 in FIG. 21*d*, about fold line 451*c* such that the eighth partition panel 452*c* is brought into face contacting relationship with the second divider panel 460*b*. The eighth partition panel 452*c* is secured to the second divider panel 460*b*.

The blank 410 is folded, as indicated by direction arrow F5 in FIG. 21*d*, about fold lines 433*a*, 433*b* such that the first and second handle reinforcing panels 432*a*, 432*b* are brought into face contacting relationship with the respective one of first and second handle panels 430*a*, 430*b* and with the respective one of the first and second divider panels 460*a*, 460*b*. The first handle reinforcing panel 432*a* is secured to the first handle panel 430*a* and to the first divider panel 460*a*. The second handle reinforcing panel 432*b* is secured to the second handle panel 430*b* and to the second divider panel 460*b*.

Glue G or other adhesive treatment is applied to; the fourth partition panel 452*d*, the eighth partition panel 452*c*, the first handle reinforcing panel 432*a* and the second handle reinforcing panel 434*b*, as shown in FIG. 21*d*.

The blank 410 is folded, as indicated by direction arrow F6 in FIG. 21*e*, about fold lines 415*a*, 417*a*. The first end panel 422*a* is brought into overlying relationship with the first side panel 416. The third end panel 422*b* is brought into overlying relationship with the second side panel 418. The first riser panel 426*a* is brought into face contacting relationship with the first handle reinforcing panel 432*a* and the fourth partition panel 452*d*. The first riser panel 426*a* is secured to the first handle reinforcing panel 432*a* and the fourth partition panel 452*d*. The third riser panel 426*b* is brought into face contacting relationship with the second handle reinforcing panel 432*b* and the eighth partition panel 452*c*. The third riser panel 426*b* is secured to the second handle reinforcing panel 432*b* and the eighth partition panel 452*c*.

Glue G or other adhesive treatment is applied to; the first riser panel 426*a*, third riser panel 426*b*, the fourth partition panel 452*d*, the eighth partition panel 452*c*, the first divider panel 460*a*, the second divider panel 460*b*, the first handle reinforcing panel 432*a* and the second handle reinforcing panel 432*b*, as shown in FIG. 21*e*.

The blank 410 is folded, as indicated by direction arrow F7 in FIG. 21*f*, about fold lines 431, (and about fold lines 443, 261 which are disposed in overlying relationship with fold line 431) such that the second side panel 418 is disposed in overlying relationship with the first side panel 416. The second handle panel 430*b* is disposed in overlying relationship with the first handle panel 430*a*. The fourth end panel 424*b* is disposed in overlying relationship with the second end panel 424*a*.

Glue G or other adhesive treatment is applied to the securing panel 420.

The blank 410 is folded, as indicated by direction arrow F8 in FIG. 21*g*, about fold line 411 so as to fold the base panel 412 upon itself, a portion of the base panel 412 is brought into face contacting relationship with the securing panel 420 and secured thereto.

A flat collapsed carrier is formed as shown in FIG. 21*g*. The flat collapsed carrier may be shipped or distributed in this flat collapsed form.

Figure 22:
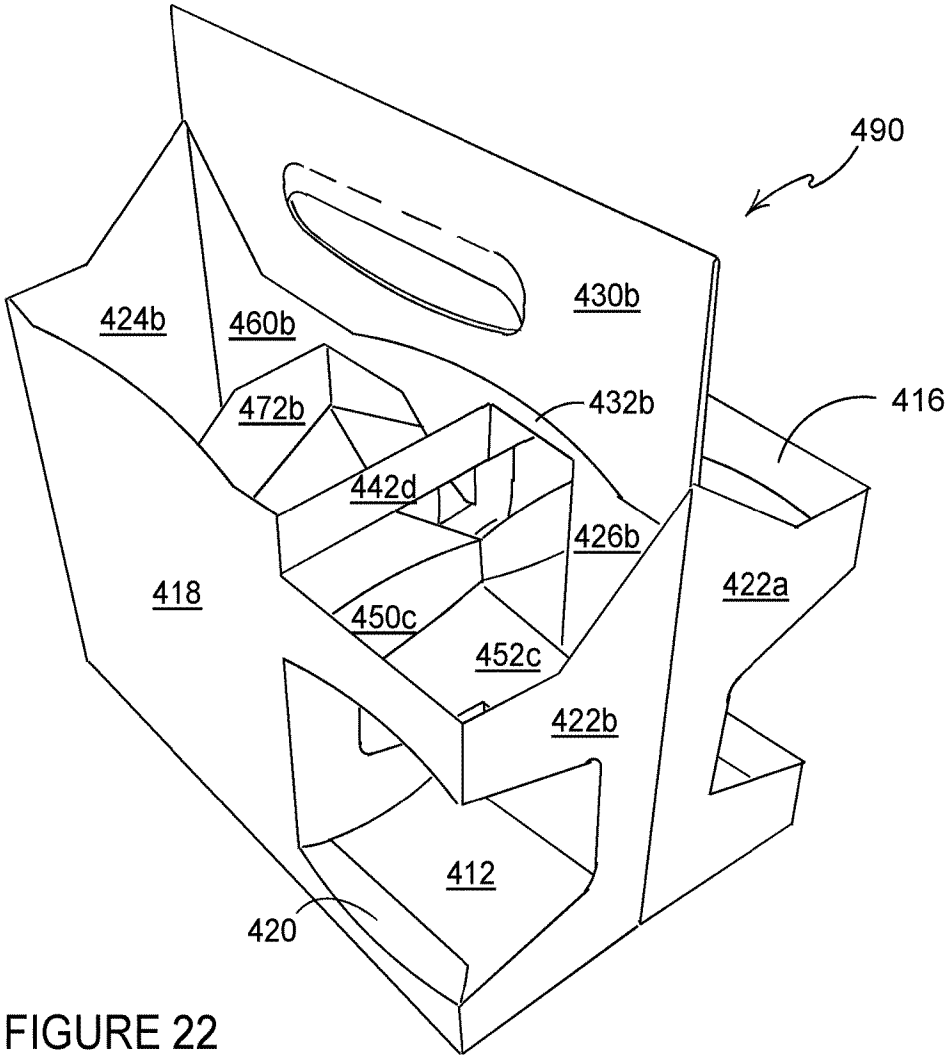
FIG. 22 is a perspective view from above of a carrier formed from the blank of FIG. 20.

The flat collapsed carrier may be erected by separating the first side panel 416 from the second side panel 418. In this way a carrier 490 is formed as illustrated in FIG. 22, the carrier 490 has a plurality of cells each for receiving an article (not shown). The illustrated carrier 490 has 6 cells, three cells on each side of the carrying handle H.

The partition structures P1, P2, D1, D2 are automatically erected within the carrier 490 when the flat collapsed carrier is erected. The carrier 490, in its erected form, may be loaded with articles through the open top end of the carrier 490.

Figure 23:
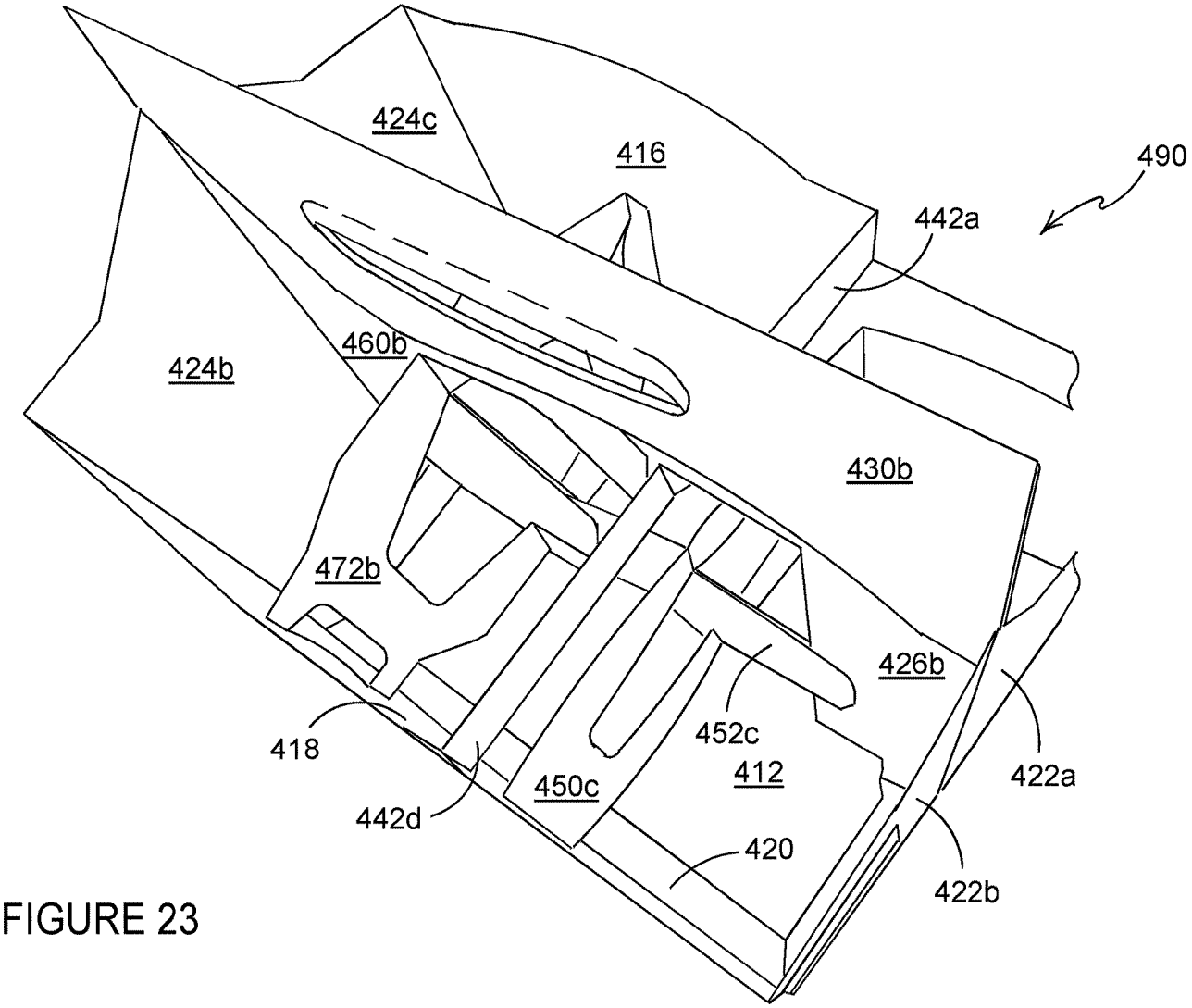
FIG. 23 is a perspective view from above of a portion of the carrier formed from the blank of FIG. 15 showing an internal cellular structure.

The carrier 490 shown in FIGS. 22 and 23 comprises a pair of transverse cell partitions on each side of the carrying handle H. Two of the cell partitions are formed from the outer walls of the carrier 490. Two of the cell partitions are formed entirely from the centrally disposed first and second divider panels 360*a*, 360*b*.

Each of the cell partitions formed entirely from the first and second divider panels 460*a*, 460*b* have an inverted "T" shaped structure. The upright member of the "T" shape is hinged to a respective one of the first and second divider panels 460*a*, 460*b*. The horizontal member of the "T" shape is secured to a respective one of the first and second side walls 416, 418.

Each of the cell partitions formed from the outer walls of the carrier 490 have a "T" shaped structure, see FIG. 23.

The lower end of each upright member of the "T" shapes (third and seventh partition panels 450*d*, 450*c*) are hinged to a respective one of the first or second side walls 416, 418. Each horizontal member of the "T" shapes (fourth and eighth partition panels 452*d*, 452*c*) is secured to a respective one of the first or second divider panels 460*a*, 460*b* at one end of its horizontal member and to a respective one of the first or third riser panels 426*a*, 426*b* at the other end of its horizontal member.

The first connecting panel 442*a* extends between the first side panel 416 and the first handle reinforcing panel 432*a*. The first connecting panel 442*a* is disposed, substantially, in vertical registry, above, the third partition panel 450*d*.

The fourth connecting panel 442*d* extends between the second side panel 418 and the second handle reinforcing panel 432*b*. The fourth connecting panel 442*d* is disposed, substantially, in vertical registry, above, the seventh partition panel 450*c*.

In alternative embodiments, the second and fourth partition structures P2, P4 may be omitted and the first connecting panel 442*a* and fourth connecting panel 442*d* provide transverse partitions along with the first and third partition structures D1, D2.

The first and second divider panels 260*a*, 260*b*, 360*a*, 360, 460*a*, 460*b* and the first, second, third and fourth riser panels 26*a*, 26*b*, 28*a*, 28*b*, 126*a*, 126*b*, 128*a*, 128*b*, each form an intermediate panel in the carrier 90, 190, 290, 390, 490 which serves to divide the carrier longitudinally. The second, fourth, sixth and eighth partition panels 52*a*, 52*d*, 52*b*, 52*c*, 152*a*, 152*d*, 152*b*, 152*c*, 252*c*, 252*d*, 398*a*, 398*b*, 452*c*, 452*d* may also be considered to form an intermediate panel which serves to divide the carrier longitudinally. The first and second divider panels 260*a*, 260*b*, 360*a*, 360, 460*a*, 460*b* additionally support transverse partitions which transverse partitions divide or segregate the carrier laterally.

It can be appreciated that various changes may be made within the scope of the present invention. For example, the size and shape of the panels and apertures may be adjusted to accommodate articles of differing size or shape. The carrier may be configured and arranged to package a different number of articles, in such embodiments the carrier may comprise an alternative number of partition structures so as to separate adjacent articles.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" each refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines. A fold line may be, but not limited to, a single score line, a single half cut, a line of perforations, a line of short slits (i.e., an interrupted slit), a line of half cuts (i.e., an interrupted half cut), a line of cuts (i.e., an interrupted cut line), a series of short score lines (i.e., an interrupted score line), any combination thereof or the like.

As used herein, the term "severance line" refers to all manner of lines formed in a substrate of sheet material, that facilitate separating portions of the substrate from one another, or otherwise indicate optimal separation locations on the substrate. For example, a severance line in a substrate of sheet material is predisposed to allow a tear to propagate there-along. A severance line may be a frangible or otherwise weakened line which includes, but not limited to, a single cut, a single slit, a single half cut, a line of perforations, a line of short slits (i.e., an interrupted slit), a line of half cuts (i.e., an interrupted half cut), a line of cuts (i.e., an interrupted cut line), a series of short score lines (i.e., an interrupted score line), any combination thereof or the like.

It should be understood that hinged connection, severance lines and fold lines can each include elements that are formed in the substrate of the blank including perforations, slits, cuts, half cuts, scores, any combination thereof, and the like. Those elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a severable or frangible fold line, or to facilitate breaking with little effort to provide a severance line.

The phrase "in registry with" as used herein refers to alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

As used herein the term "cutaway" refers to all manner of shapings, recesses, apertures, cuts, slots, holes and gaps which may be circular, rectangular, capsule shaped, irregular shaped and many other shapes that are pre-formed or pre-defined.

The invention claimed is:

1. A carrier for packaging one or more articles, the carrier comprising:

a plurality of outer walls which define an interior;

an intermediate wall at least partially segregates the interior of the carrier in a first direction; and a first partition structure divides, at least in part, the interior in a second transverse direction, wherein the first partition structure is struck, at least in part, from at least a first one of the plurality of outer walls so as to define a first window in the at least a first one of the plurality of outer walls at a first end of the carrier, a second partition structure divides, at least in part, the interior in a second transverse direction, wherein the second partition structure is struck, at least in part, from at least a second one of the plurality of outer walls so as to define a second window in the at least a second one of the plurality of outer walls at the first end of the carrier, and wherein the first and second partition structures are configured and arranged to be automatically erected in the interior of the carrier in response to unfolding a flat collapsed folded blank when the carrier is erected, wherein the first partition structure comprises a first partition panel struck from a first one of the plurality of outer walls and a second partition panel hinged to the first partition panel, wherein the second partition panel is struck from a second one of the plurality of outer walls, the second one of the plurality of outer walls being disposed adjacent to the first one of the plurality of outer walls.

2. The carrier according to claim 1 wherein the second one of the plurality of outer walls is hinged to the first one of the plurality of outer walls.

3. A carrier for packaging one or more articles, the carrier comprising:

a plurality of outer walls which define an interior;

an intermediate wall at least partially segregates the interior of the carrier in a first direction; and a first partition structure divides, at least in part, the interior in a second transverse direction, wherein the first partition structure is struck, at least in part, from at least a first one of the plurality of outer walls so as to define a first window in the at least a first one of the plurality of outer walls at a first end of the carrier, a second partition structure divides, at least in part, the interior in a second transverse direction, wherein the second partition structure is struck, at least in part, from at least a second one of the plurality of outer walls so as to define a second window in the at least a second one of the plurality of outer walls at the first end of the carrier, and wherein the first and second partition structures are configured and arranged to be automatically erected in the interior of the carrier in response to unfolding a flat collapsed folded blank when the carrier is erected, wherein the first partition structure comprises a first partition panel struck from a first one of the plurality of outer walls and a second partition panel hinged to the first partition panel, and wherein the second partition panel is folded to at least partially segregate the interior of the carrier in the first direction.

4. The carrier according to claim 1 wherein the second partition structure comprises a third panel struck from a third one of the plurality of outer walls and a fourth panel hinged to the third panel.

5. The carrier according to claim 1 wherein the second partition panel is struck from the second one of the plurality of outer walls, the second one of the plurality of outer walls being disposed adjacent to the third one of the plurality of outer walls.

6. The carrier according to claim 1 wherein the first and second partition structure are folded out of the plane of the respective panels from which they are struck prior to erection of the carrier from the flat collapsed folded blank.

7. A carrier for packaging one or more articles, the carrier comprising:

a plurality of outer walls which define an interior;

an intermediate wall that at least partially segregates the interior of the carrier in a first direction; and at least one partition structure that divides, at least in part, the interior in a second transverse direction, the at least one partition structure struck from at least a first one of the plurality of outer walls, the at least one partition structure comprising:

a first partition panel hinged to one of the plurality of outer walls, and a second partition panel hingedly connected to the first partition panel;

wherein the second partition panel is secured to the intermediate wall, wherein the at least one partition structure is struck from a first one of the plurality of walls and a second one of the plurality of walls, the second one of the plurality of walls being disposed adjacent to the first one of the plurality of walls, wherein the at least one partition structure is struck in part from the intermediate wall.

8. The carrier according to claim 7 wherein the at least one partition structure is configured and arranged to be automatically erected in the interior of the carrier when the carrier is erected from a flat collapsed folded blank.

9. The carrier according to claim 7 wherein the at least one of the plurality of outer walls comprises an outer surface and an inner surface and the second partition panel is folded such that the inner surface of the second partition panel faces the inner surface of the at least one of the plurality of outer walls to which the first partition panel is hingedly connected.

10. The carrier according to claim 7 wherein a portion of the second partition panel is struck from the first partition panel and forms a "T" shaped partition structure.

11. The carrier according to claim 7 wherein the intermediate panel comprises a securing panel struck therefrom and hingedly connected thereto, the securing panel being secured in at least partial overlapping relationship with the first partition panel.

12. The carrier according to claim 7 wherein the carrier comprises at least one handle panel forming a carrying handle, the handle panel being secured to the intermediate panel.

13. The carrier according to claim 7 wherein the intermediate panel comprises a cutaway forming part of a carrying handle.

* * * * *